US010612354B2

(12) United States Patent
Martysevich et al.

(10) Patent No.: US 10,612,354 B2
(45) Date of Patent: Apr. 7, 2020

(54) JETTING APPARATUS FOR FRACTURING APPLICATIONS

(71) Applicant: HALLIBURTON ENERGY SERVICES, INC., Houston, TX (US)

(72) Inventors: Vladimir Nikolayevich Martysevich, Spring, TX (US); Jim B. Surjaatmadja, Duncan, OK (US); Timothy P. O'Connell, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 218 days.

(21) Appl. No.: 15/565,842

(22) PCT Filed: Jun. 23, 2015

(86) PCT No.: PCT/US2015/037216
§ 371 (c)(1),
(2) Date: Oct. 11, 2017

(87) PCT Pub. No.: WO2016/209214
PCT Pub. Date: Dec. 29, 2016

(65) Prior Publication Data
US 2018/0112506 A1 Apr. 26, 2018

(51) Int. Cl.
*E21B 43/26* (2006.01)
*E21B 43/114* (2006.01)

(52) U.S. Cl.
CPC ..... *E21B 43/26* (2013.01); *E21B 43/114* (2013.01)

(58) Field of Classification Search
CPC ..... E21B 43/114
See application file for complete search history.

(56) References Cited

U.S. PATENT DOCUMENTS 2,228,640 A * 1/1941 O'Neill ..... E21B 37/00 166/223
4,050,529 A * 9/1977 Tagirov ..... E21B 43/112 175/424

(Continued)

FOREIGN PATENT DOCUMENTS

CA 2560611 A1 9/2005

OTHER PUBLICATIONS

Halliburton Production Solutions, Downhole Tool Solutions, Addressing the Downhole Challenges with Reliability, H010540, Aug. 2013.

(Continued)

*Primary Examiner* — Robert E Fuller
(74) *Attorney, Agent, or Firm* — Polsinelli PC

(57) ABSTRACT

A downhole hydra-jetting apparatus has a substantially cylindrical guide housing having an outer surface and an inner surface, and defining a cavity longitudinally extending through the guide housing; a plurality of retractable guide members attached radially around the guide housing; and a substantially cylindrical jet housing having an outer surface and an inner surface, and defining a cavity longitudinally extending through the jet housing, with a plurality of jetting nozzles defined in, and radially positioned about, the jet housing. Each of the plurality of jetting nozzles are adjustable relative to the guide housing to allow substantial alignment of projections from the plurality of jetting nozzles and the plurality of guide members when the guide members are extended radially from the outer surface of the guide housing and the apparatus is actively moved through a downhole.

19 Claims, 15 Drawing Sheets

(56) References Cited

U.S. PATENT DOCUMENTS

| | | | | |
|---|---|---|---|---|
| 5,445,220 | A * | 8/1995 | Gurevich | B24C 1/045 166/223 |
| 5,765,642 | A | 6/1998 | Surjaatmadja | |
| 6,719,054 | B2 | 4/2004 | Cheng et al. | |
| 7,445,045 | B2 | 11/2008 | East et al. | |
| 7,571,766 | B2 | 8/2009 | Pauls et al. | |
| 2005/0133226 | A1 | 6/2005 | Lehman | |
| 2006/0185848 | A1 | 8/2006 | Surjaatmadja et al. | |
| 2008/0271892 | A1 | 11/2008 | Lynde et al. | |
| 2010/0243253 | A1 | 9/2010 | Surjaatmadja et al. | |
| 2012/0217014 | A1 | 8/2012 | Groves | |
| 2015/0027692 | A1 | 1/2015 | East et al. | |

OTHER PUBLICATIONS

Halliburton Production Solutions, Pinpoint Stimulation, Short-Term Efficiency. Long-Term Performance., H010277, Jun. 2013.
Halliburton Production Solutions, Stimulation, SurgiFracSM Service, A Quick and Cost-Effective Method to Help Boost Production From Openhole Horizontal Completions, H08533, Sep. 2013.
Logan International, Kline Production Tools, Well Servicing Equipment, Downhole Swivel Joint, 2015.
Wellvention ALS Oil and Gas Company, Swivel Joint Data Sheet, 2015, http://www.wellvention.com/productinfo/swivel-joint.
International Search Report and Written Opinion; PCT Application No. PCT/US2015/037216; dated Mar. 10, 2016.
Canadian Office Action; Canada Application No. 2,985,341; dated Aug. 29, 2018.

* cited by examiner

JETTING APPARATUS FOR FRACTURING APPLICATIONS

CROSS-REFERENCE TO RELATED APPLICATIONS

This application is a national stage entry of PCT/US2015/037216 filed Jun. 23, 2015, said application is expressly incorporated herein in its entirety.

FIELD

The present disclosure relates to the fracturing of subterranean formations, such as in a well, by jetting fluid from a hydra-jetting apparatus. More particularly, the present disclosure relates to a hydra-jetting apparatus for creating multiple fractures in subterranean formations and methods of using the same.

BACKGROUND

To liberate hydrocarbons (e.g., oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed. Such completion operations may include inserting a liner or casing into the wellbore and, at times, cementing a casing or liner into place. Once the wellbore is completed as desired (lined, cased, open hole, or any other known completion) a stimulation operation may be performed to enhance hydrocarbon production into the wellbore. Examples of some common stimulation operations involve hydraulic fracturing, acidizing, fracture acidizing, and hydra-jetting. Stimulation operations are intended to increase the flow of hydrocarbons from the subterranean formation surrounding the wellbore into the wellbore itself so that the hydrocarbons may then be produced up to the wellhead.

Hydraulic fracturing specifically is often utilized to stimulate the production of hydrocarbons from subterranean formations penetrated by wellbores. In performing hydraulic fracturing treatments, a production zone or portion of a formation to be fractured is isolated using conventional packers or the like, and a fracturing fluid is pumped through the wellbore into the isolated portion of the formation to be stimulated at a rate and pressure such that fractures are formed and extended into the formation. Propping agents, or "proppants," function to prevent the fractures from closing and thereby provide conductive channels in the formation through which fluids can readily flow to the wellbore.

In wells penetrating very low to medium permeability formations, and/or wells not producing to expectations, it is often desirable to create fractures in the formations near the wellbores in order to improve hydrocarbon production from the formations. Furthermore, in some wells, it is desirable to individually and selectively create multiple fractures having adequate conductivity, usually at predefined distances apart along the wellbore, so that as much of the hydrocarbons in an oil and gas reservoir as possible can be drained/produced into the wellbore. When stimulating a reservoir from a wellbore, especially those that are highly deviated or horizontal, to create multizone fractures along the wellbore, it may be necessary to cement a liner, or casing, to the wellbore and mechanically isolate the zone being fractured from other previously fractured zones or zones to be subsequently fractured.

In order to create such fractures in formations penetrated by cased or uncased wellbores, a jetting apparatus can be used wherein the jetting apparatus is equipped with jetting nozzles which expel high velocity fluids from the jetting apparatus toward the subterranean formation. Using this method, multiple fractures can be created one at a time or at the same time. To create the fractures, jetting nozzles are placed within the wellbore such that they are set at predetermined locations on the jetting apparatus to create fractures at defined locations or geometries relative to the wellbore.

BRIEF DESCRIPTION OF THE DRAWINGS

Implementations of the present technology will now be described, by way of example only, with reference to the attached figures, wherein.

Figure 1:
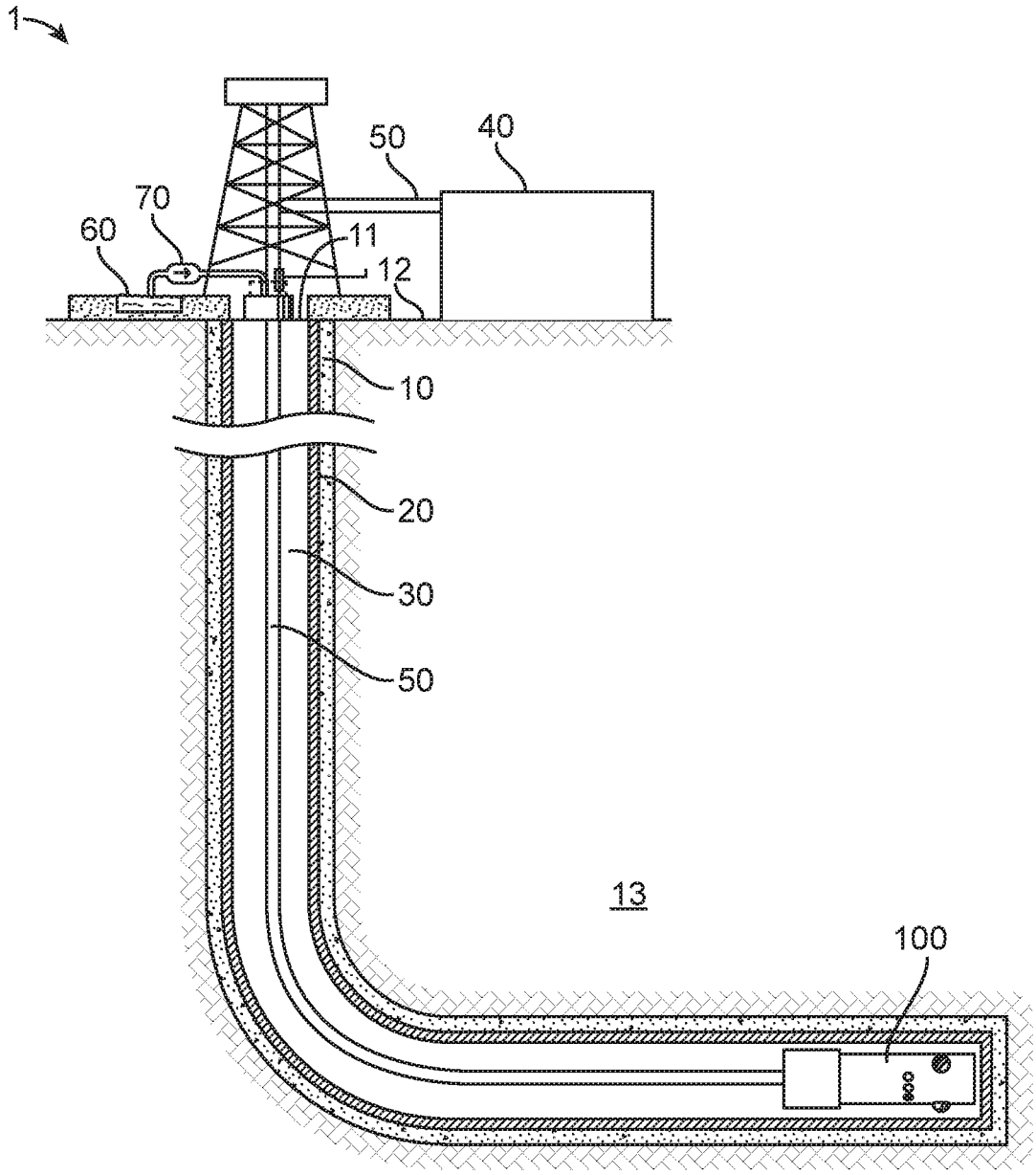
FIG. 1 is a diagram illustrating an exemplary system for a hydra-jetting apparatus according to the disclosure herein.

It should be understood that the various aspects are not limited to the arrangements and instrumentality shown in the drawings.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or apparatus. Additionally, the illustrated embodiments are illustrated such that the orientation is such that the right-hand side or bottom of the page is downhole compared to the left-hand side, and the top of the page is toward the surface, and the lower side of the page is downhole. Furthermore, the term "proximal" refers directionally to portions further toward the surface in relation to the term "distal" which refers directionally to portions further downhole and away from the surface in a wellbore.

Several definitions that apply throughout this disclosure will now be presented. The term "coupled" is defined as connected, whether directly or indirectly through intervening components, and is not necessarily limited to physical connections. The term "communicatively coupled" is defined as connected, either directly or indirectly through intervening components, and the connections are not necessarily limited to physical connections, but are connections that accommodate the transfer of data between the so-described components. The connection can be such that the objects are permanently connected or releasably connected. The term "outside" refers to a region that is beyond the outermost confines of a physical object. The term "axially" means substantially along a direction of the axis of the object. If not specified, the term axially is such that it refers to the longer axis of the object. The terms "comprising," "including" and "having" are used interchangeably in this disclosure. The terms "comprising," "including" and "having" mean to include, but are not necessarily limited to, the things so described.

In wells penetrating subterranean formations, especially horizontal and deviated wells which are case or uncased, it is often desirable to create small fractures in the formations adjacent to the wellbore to improve hydrocarbon production therefrom. Disclosed herein is a downhole hydra-jetting apparatus which can be used to create continuous or incrementally spaced fractures in a subterranean formation radially, relative to the wellbore, by continuously changing the fracture orientation direction. The hydra-jetting apparatus can be substantially cylindrical. The hydra-jetting apparatus can have a plurality of jetting nozzles. The apparatus is placed adjacent to a production zone in the wellbore, and fluid is then jetted through the nozzles against the formation sufficient to form a cavity therein and fracture the formation by stagnation pressure in the cavity. A high stagnation pressure is produced at the tip of the cavity in a formation being jetted because the jetted fluids become trapped in the cavity as a result of having to flow out of the cavity in a direction generally opposite to the direction of the incoming jetted fluid. The high pressure exerted on the formation at the tip of the cavity causes a fracture to form and extend a short distance into the formation.

In order to extend a fracture, formed as described above, further into the formation, a fluid is pumped from the surface into the wellbore to raise the ambient fluid pressure exerted on the formation while the formation is being fractured by the fluid jets produced by the hydra-jetting apparatus. The fluid in the wellbore flows into the cavity produced by the fluid jet and flows into the fracture at a rate and pressure sufficient to extend the fracture an additional distance from the wellbore into the formation.

The hydra-jetting apparatus can also have a plurality of guide members, which are transitionable from a retracted position and a deployed position. In the deployed position, the plurality of guide members, angled relative to the longitudinal axis of the hydra-jetting apparatus, engage the inner surface of an uncased or cased wellbore or within the formed perforation cuts or slots. The hydra-jetting apparatus will continuously rotate in a spiral, corkscrew, or helical path or projection relative to the longitudinal axis of the hydra-jetting apparatus as it moves along the length the wellbore. The degree and nature of rotation relative to the longitudinal axis will be determined by the angle of the centrally raised protrusions or wheels. The guide members can be substantially equivalently spaced apart from each other about the circumference of the guide housing. In other words, the guide members can be positioned axially or longitudinally at about the same location between, and distances from, the proximal end and the distal end of the guide housing.

In some cases, the spiral, corkscrew, or helical path or projection of the jetting nozzles and the spiral, corkscrew, or helical path or projection of the guide members are not desired to be aligned. When the spiral, corkscrew, or helical paths or projections of the guide members and jetting nozzles are not desired to be aligned the number of guide members and jetting nozzles can be the same or different. In other cases, each one of the plurality of guide members follows a same or substantially aligned spiral, corkscrew, or helical path or projection as a corresponding one of the jetting nozzles.

FIG. 1 is a diagram illustrating an exemplary system for a hydra-jetting apparatus 100 according to the disclosure herein. The hydra-jetting apparatus 100 can be employed in the exemplary wellbore system 1. The system 1 for drilling a wellbore 10 includes a wellhead 11 at the surface 12. The wellbore 10 extends and penetrates various earth strata to situate the hydra-jetting apparatus 100 in a subterranean formation 13. A string source 40 has a tool string 50 extending in to the wellbore 10 with the hydra-jetting apparatus 100 coupled to the tool string 50. The string source 40 can be, for example, a truck or physical structure immobilized to the surface 12. It should be noted that while FIG. 1 generally depicts a land-based operation, those skilled in the art will readily recognize that the principles described herein are equally applicable to subsea operation that employ floating or sea-based platforms and rigs, without departing from the scope of the disclosure.

Disposed within the wellbore 10 is a casing or liner 20 that can be cemented or otherwise adhered to the inner surface of the wellbore 10. The cement or adherent is therefore provided in the annulus between the casing or liner 20 and the walls of the wellbore 10. Formed between the casing or liner 20 and the tool string 50, and extending from the wellhead 11, is an annulus 30. A pump 70 is provided which pumps mud 60, production fluid, or other fluids described herein into the wellhead 11.

After drilling the wellbore 10, and before, during, or after production, various downhole devices can be placed in the wellbore system 1 and then retrieved. The downhole hydra-jetting apparatus 100 can be used to create continuous, incrementally spaced fractures in a subterranean formation radially relative to the wellbore 10 by continuously changing the orientation of the fracture initiation direction. The hydra-jetting apparatus 100 can be substantially cylindrical and configured to continuously rotate in a spiral, corkscrew, or helical manner relative to a longitudinal axis of the apparatus 100 as it moves along the length of the wellbore 100.

Figure 2:
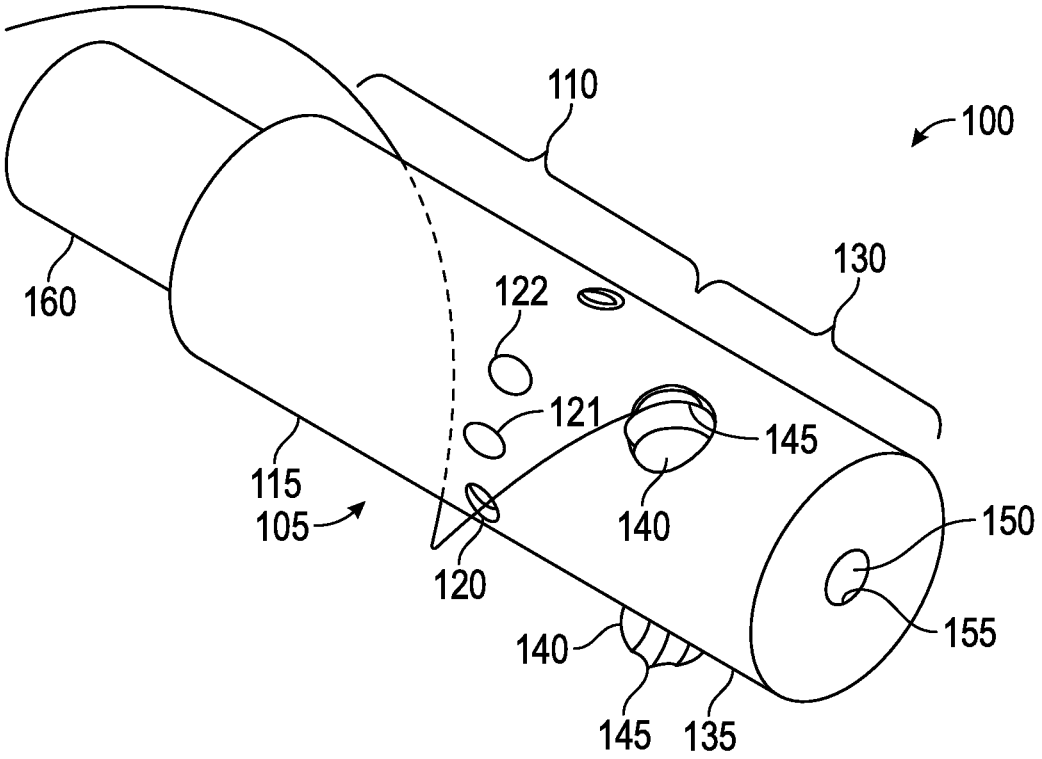
FIG. 2 is a diagram illustrating an exemplary hydra-jetting apparatus.

FIG. 2 is a diagram illustrating an exemplary hydra-jetting apparatus 100. The hydra-jetting apparatus 100 has an outer surface 105 and an inner surface 155 which defines a cavity 150 longitudinally extending through the apparatus 100 which houses various components such as those described herein. The hydra-jetting apparatus 100 has a substantially cylindrical guide housing 130 and a substantially cylindrical jet housing 110.

The guide housing 130 can include an outer surface 135 and an inner surface (not shown) which can define a cavity (not shown) longitudinally extending through the guide housing 130. The cavity 150 includes the guide housing cavity. The guide housing 130 further includes a plurality of retractable guide members 140 attached radially around the guide housing 130.

Each of the plurality of guide members 140 can be generally cylindrical in shape with a spherical end having a centrally raised protrusion 145 extending radially from the generally spherical outer end surface of the guide member 140. The centrally raised protrusions 145 can have a rounded or sharp edge which is configured to press against the casing or liner 20 of the wellbore 10 (see FIG. 1) and/or seat within perforation cuts or slots made by a plurality of jetting nozzles 120-122 (see below) by the fluid jetting processes described herein. The guide members 140 and centrally raised protrusions 145 can be adjustable to be directionally oriented at different angles as desired relative to the longitudinal axis of the guide housing 130. The guide members 140 and centrally raised protrusions 145 can be further configured maintain their directional orientation during use with a directional locking member (not shown) coupled or connected to each of the guide housing 130 and the guide member 140.

Alternatively, each of the plurality of guide members 140 can be substantially in the shape of a wheel wherein a surface of the wheel is configured to press against the casing or liner 20 of the wellbore 10. Further, each wheel can have a raised edge around the outer perimeter. The wheels can be adjustable to be directionally oriented at different angles as desired relative to the longitudinal axis of the guide housing 130. The wheels can be further configured maintain their directional orientation during use with a directional locking member coupled or connected to each of the guide housing 130 and the guide member 140.

While the guide members 140 are disclosed as being generally cylindrical with spherical ends in shape, with a centrally raised protrusion extending radially from the generally spherical outer end surface, or in the shape of a wheel, the guide members 140 can be any size, shape, or configuration capable of guiding the hydra-jetting apparatus 100 along a spiral, corkscrew, or helical path or projection relative to the longitudinal axis of the hydra-jetting apparatus 100 as it moves along the length the wellbore 10. While the exemplary hydra-jetting apparatus 100 has centrally raised protrusions, the protrusions can be raised on either or both lateral sides or other configurations which are not limited, but which may act to press against the casing or liner 20.

Each of the plurality of retractable guide members 140 are movable from a retracted position, wherein the plurality of guide members do not extend beyond the outer surface 135 of the guide housing 130, to a deployed position, wherein at least a portion of one or more of the plurality of retractable guide members 140 extend beyond the outer surface 135 of the guide housing 130. FIG. 2 illustrates the plurality of guide members 140 in a deployed position The guide housing 130 can have a plurality of apertures or recesses (not shown) having an inner diameter and extending radially from the cavity through the outer surface 135 of the guide housing 130. Each aperture or recess can receive a guide member 140 therein and can be flush with the outer surface 135 when in the retracted position. The guide members 140 can have an outer diameter which is substantially the same as, or slightly smaller than, an inner diameter of the aperture or recess. Each of the plurality of guide members 140 can be extended radially to protrude out of the outer surface 135 of the guide housing 130. Each of the plurality of guide members 140 can also be retracted radially to return to the contained within or flush configuration using a retention mechanism (not shown).

Each guide member 140 can be coupled to a spring mechanism (not shown), serving as the retention mechanism, which holds the guide member 140 in the retracted position. The spring mechanism can include an extension spring, tension spring or any other suitable spring. Alternatively, each guide member 140 can be coupled to a rubber or elastomeric band or strip, serving as the retention mechanism, which holds the guide member 140 in the retracted position.

Alternatively, each of the plurality of guide members 140 can be deployed in response to a change in pressure within the cavity of the guide housing 130. The change in pressure results in a higher pressure within the cavity than the pressure within the wellbore and is sufficiently large enough to overcome the retractive force of the retention mechanism.

Alternatively, both retraction and deployment of the guide members 140 can be accomplished using the same mechanism. Retraction and deployment can be accomplished using hydraulic or pneumatic pistons (not shown) which are located partially or fully within the apertures or recesses and communicatively coupled to the inner surface of the housing 110 (not shown) to be controlled by the surface pressure.

The guide members 140, retraction and/or deployment mechanisms, and guide housing 130 can be coupled or connected in any manner known to one of ordinary skill in the art which allows the guide members to remain secured within the apertures or recesses of the guide housing 130 and freely transition between the retracted and deployed positions.

When the plurality of guide members 140 are contained within or flush with the substantially cylindrical outer surface 135 of the guide housing 130, the hydra-jetting apparatus 100 has a maximum outer diameter that is smaller than the inner diameter of the well casing 20. When the plurality of guide members 140 is actuated to protrude out of the surface of the substantially cylindrical outer surface 135 of the guide housing 130, they increase the effective outer diameter of the hydra-jetting apparatus 100. The effective outer diameter of the hydra-jetting apparatus 100 when the guide members 140 are deployed can be the same as or slightly larger than the inner diameter of the well casing 20 of the wellbore 10 such that each of guide members 140 physically contacts and interacts with the well casing 20 and/or seat within perforation cuts or slots made by the jetting nozzles by the fluid jetting processes described herein.

The centrally raised protrusions 145 can be adjustable to be directionally oriented at different angles as desired relative to the longitudinal axis of the guide housing 130. In some embodiments, the centrally raised protrusions 145 can be adjustable to any angle between 0° and 180° relative to the longitudinal axis of the guide housing 130. Alternatively, the centrally raised protrusions 145 can be adjustable to any angle setting between 0° and 90° relative to the longitudinal axis of the guide housing 130. Alternatively, the centrally raised protrusions 145 can be adjustable to specific angle settings such as, for example, 15°, 30°, 45°, 60°, 75°, 105°, and so on, relative to the longitudinal axis of the guide housing 130. Alternatively, the centrally raised protrusions 145 can be adjustable to specific angle settings such as, for example, 20°, 40°, 60°, 80°, 100°, 120°, and so on, relative to the longitudinal axis of the guide housing 130. One of ordinary skill in the art will readily appreciate that adjustment of the angle settings of the centrally raised protrusions also results in adjustment of the guide members 140 and vice versa. One of ordinary skill will further appreciate that any reference in this disclosure to adjusting the angle setting of the centrally raised protrusions or the guide members 140 to mean that both are adjusted concomitantly.

The jet housing 110 has an outer surface 115 and an inner surface (not shown) which can define a cavity (not shown) longitudinally extending through the jet housing 110. The cavity 150 includes the jet housing cavity. The jet housing 110 further includes a plurality of jetting nozzles 120-122 defined in, and radially positioned about, the jet housing 110. The cavity of the jet housing 110 and the cavity of the guide housing 130 are in fluid communication with each other and form at least a portion of the cavity 150. Each of the plurality of jetting nozzles 120-122 are adjustable relative to the guide housing 130 to allow substantial alignment of projections (e.g. of fluid) from the plurality of jetting nozzles 120-122 and the plurality of guide members 140 when the guide members 140 are extended radially from the outer surface 135 of the guide housing 130 and the apparatus 100 is actively moved through the wellbore 10.

One of ordinary skill in the art will appreciate that the jetting nozzles 120-122 can be any component that allows fluid to be jetted from the cavity 150 and though the outer surface 115 of the jet housing 110. In the exemplary hydra-jetting apparatus 100, jetting nozzles 120-122 are apertures extending from the cavity 150 and though the outer surface 115 of the jet housing 110. Alternatively, the jetting nozzles 120-122 can be conical, bell-shaped, annular, parallel, convergent, divergent, convergent-divergent, ring, flat tipped, current non-circular or any other nozzle shape known by one of ordinary skill in the art. Furthermore, the nozzle can be fully or partially contained within the jet housing 110

The outer surface 115 of the jet housing 110 and the outer surface 135 of the guide housing 130 can be substantially the same diameter, the inner surfaces of the jet housing 110 and guide housing 130 can be substantially the same diameter, and the cavities of the jet housing 110 and the guide housing 130 can be substantially the same diameter. Alternatively, the outer surface 115 of the jet housing 110 and the outer surface 135 of the guide housing 130 can be substantially the same diameter while the diameters of the inner surface and cavity of the guide housing 130 are larger than those of the jet housing 110. Alternatively, the outer surface 115 of the jet housing 110 and the outer surface 135 of the guide housing 130 can be substantially the same diameter while the diameters of the inner surface and cavity of the guide housing 130 are smaller than those of the jet housing 110.

When the jet housing 110 and guide housing 130 are together as one component, as in FIG. 2, the number of jetting nozzles can equal the number of guide members 140 multiplied by the number of guide member angle settings. For example, in the exemplary embodiment, the hydra-jetting apparatus 100 has four guide members 140 which can each be adjusted to three different angle settings having spiral, corkscrew, or helical paths aligned with one of the corresponding jetting nozzles 120-122. Here, the jet housing 110 has 12 jetting nozzles where each guide member 140 is associated with three jetting nozzles 120-122 spaced apart from each other. At a first guide member angle setting, the guide member 140 shares a spiral, corkscrew, or helical path or projection with one of the three jetting nozzles 120-122, at a second guide member angle setting, the guide member 140 shares a spiral, corkscrew, or helical path or projection with a different one of the three jetting nozzles 120-122, and so on. The jetting nozzles that do not share the same spiral, corkscrew, or helical path or projection as one of the guide members 140 can be capped, plugged, or otherwise reversibly sealed to prevent fluid jetting from those jetting nozzles. The number of guide members 140 can be from 2-8, alternatively 2-6, alternatively 3-5, or alternatively 4. The outer surface of the hydra-jetting apparatus 100 can be marked with one or more guide lines to assist in proper alignment of the spiral, corkscrew, or helical paths or projections at different guide member angle settings. In general, the jetting nozzles 120-122 are configured to jet fluid in a direction which is radially away from the outer surface of the hydra-jetting apparatus 100. One of ordinary skill in the art, however, will appreciate that jetting nozzles can be configured to jet fluid at any desired angle relative to the longitudinal axis or radially around the surface of the hydra-jetting apparatus 100. The nozzles 120-122 can be configured such that the angle of the jetted fluid and the longitudinal axis would form an acute angle in either the uphole or downhole direction. Further, the fluid can be jetted from the nozzles 120-122 tangentially or normal to the outer surface, or any angle therebetween, of the hydra-jetting apparatus 100.

The hydra-jetting apparatus 100 further includes a coupling mechanism 160 which can be configured to threadedly or otherwise couple the hydra-jetting apparatus 100 to the tool string 50 directly or indirectly through intervening components. The coupling mechanism 160 can have an outer surface 165 and an inner surface (not shown) which can define a cavity (not shown) longitudinally extending through the hydra-jetting apparatus 100. The cavity 150 includes the coupling mechanism cavity. The cavity of the jet housing 110, the cavity of the guide housing 130, and the cavity of the coupling mechanism 160 are in fluid communication with each other and form at least a portion of the cavity 150. The coupling mechanism can be threaded to threadedly engage the tool string 50 or intervening components.

Figure 3:
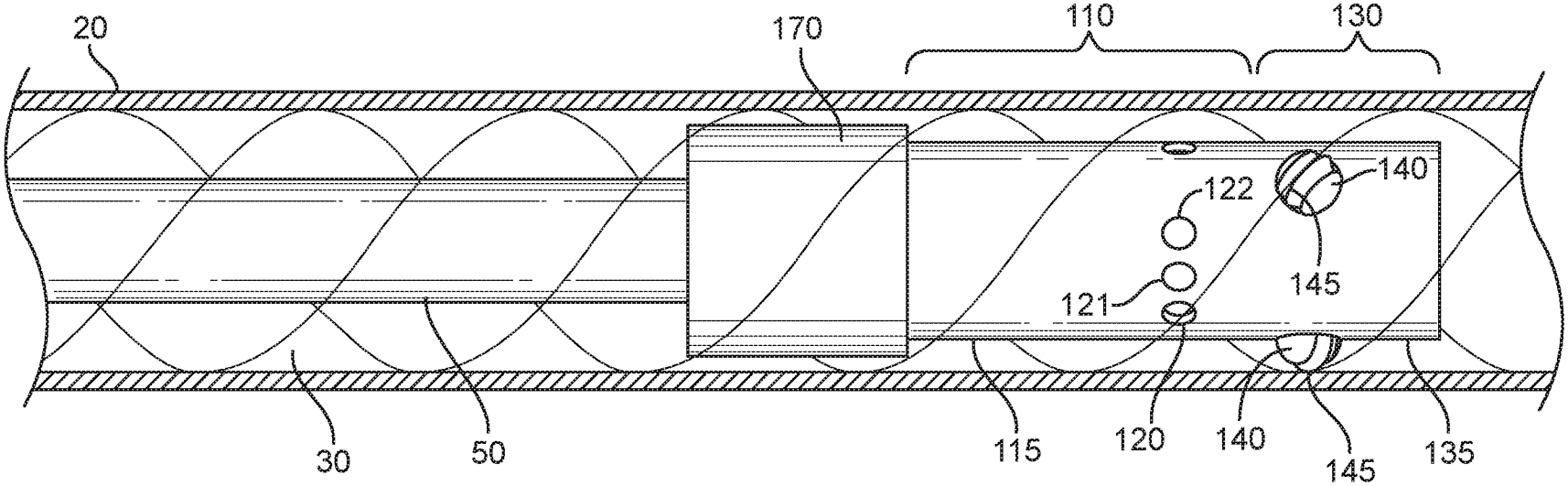
FIG. 3 is a diagram of the exemplary hydra-jetting apparatus of FIG. 2 coupled to a tool string and situated in a wellbore.

FIG. 3 is a diagram of the exemplary hydra-jetting apparatus 100 of FIG. 2 coupled to the tool string 50 and situated in the wellbore casing 20. The hydra-jetting apparatus 100 is coupled to the tool string 50 via a rotatable coupling (not shown). The rotatable coupling is contained within a housing 170 and threadedly or otherwise couples to each of the tool string 50 and coupling mechanism 160 of the hydra-jetting apparatus 100.

When the centrally raised protrusions 145 are deployed to engage the casing 20 of wellbore or be within the perforation cuts or slots in the casing 20, the hydra-jetting apparatus 100 will continuously rotate in a spiral, corkscrew, or helical path or projection, as shown in FIG. 3, relative to the longitudinal axis of the hydra-jetting apparatus 100 as it moves along the length the wellbore. The degree and nature of rotation will be determined by the angle setting of the centrally raised protrusions 145. In FIG. 3, the topmost portion of the centrally raised protrusion 145 is set to a first angle setting which is substantially aligned in a same spiral, corkscrew, or helical path as jetting nozzle 120. Jetting nozzle 120 is therefore open for fluid jetting processes. Jetting nozzles 121 and 122, which are not on the same spiral, corkscrew, or helical path as protrusion 145, are capped, plugged or otherwise reversibly sealed.

Figure 4:
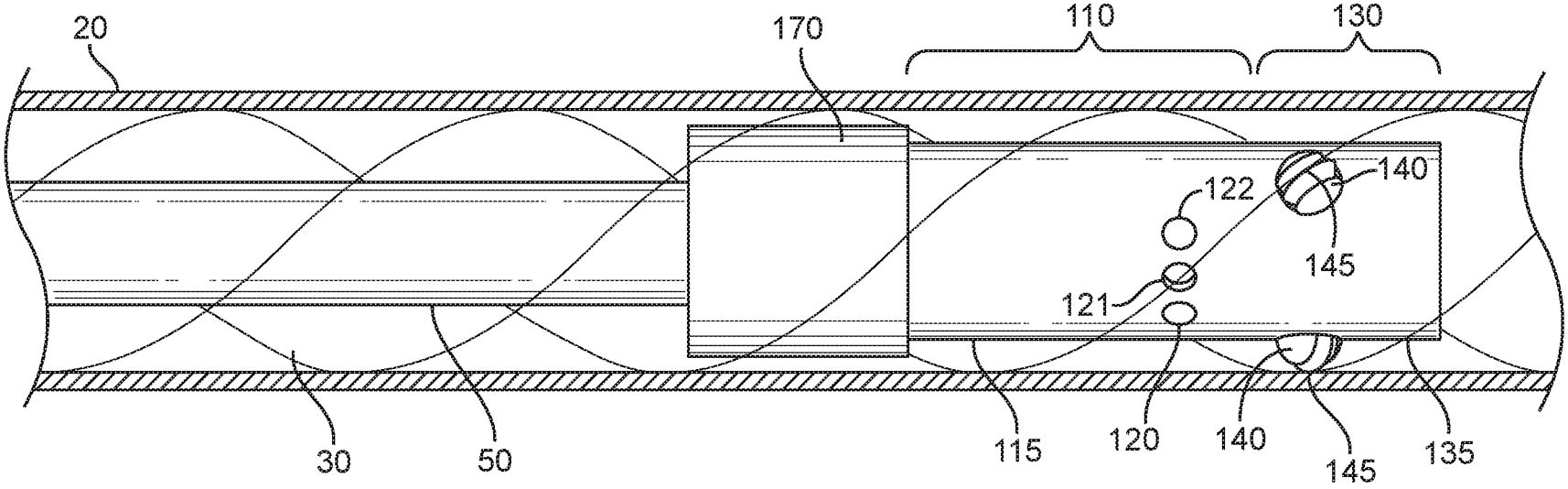
FIG. 4 is a diagram of a second configuration of the exemplary hydra-jetting apparatus of FIG. 2 coupled to the tool string and situated in the wellbore.

FIG. 4 is a diagram of a second configuration of the exemplary hydra-jetting apparatus 100 of FIG. 2 coupled to the tool string 50 and situated in the wellbore casing 20. Here, the centrally raised protrusion 145 is set to a second angle setting which results in a spiral, corkscrew, or helical path which coincides with jetting nozzle 121. Jetting nozzle 121 is therefore open for fluid jetting processes. Jetting nozzles 120 and 122, which are not on the same spiral, corkscrew, or helical path as protrusion 145, are capped, plugged or otherwise reversibly sealed.

While the exemplary embodiment shown in FIGS. 3-4 is described wherein the centrally raised protrusions 145 are discussed as being in a same spiral, corkscrew, or helical path as a corresponding open jetting nozzle while the other two jetting nozzles are capped, plugged, or otherwise reversibly sealed, one of ordinary skill may appreciate circumstances in which the jetting nozzles in the same spiral, corkscrew, or helical path as protrusion 145 would be sealed while one of the jetting nozzles is left open such that fluid jetting paths and the protrusion paths are not the same. Furthermore, while the exemplary hydra-jetting apparatus 100 is shown as used in a wellbore with casing 20, one of ordinary skill may appreciate that the exemplary hydra-jetting apparatus 100 may be used in an uncased wellbore under certain conditions.

Figure 5:
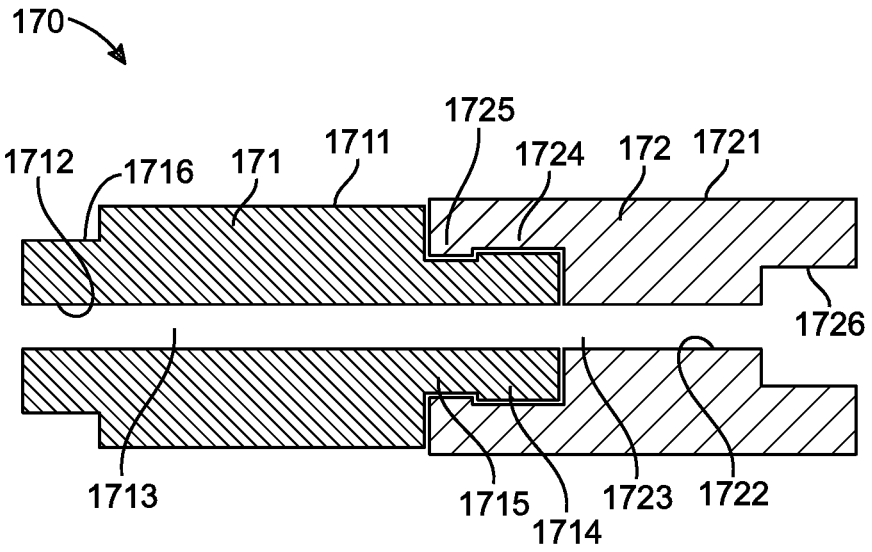
FIG. 5 is a diagram of an exemplary rotatable coupling for coupling the hydra-jetting apparatus to the tool string.

FIG. 5 is a cross-sectional view of an exemplary rotatable coupling 170 for coupling a hydra-jetting apparatus 100 to the tool string 50. The rotatable coupling 170 has a first free-rotation member 171, to threadedly or otherwise couple to the tool string 50 via coupling surface 1716, and a second free-rotation member 172, to threadedly or otherwise couple to the coupling mechanism 160 of the hydra-jetting apparatus 100 via coupling surface 1726. The first free-rotation member 171 has an outer surface 1711 and an inner surface 1712 which defines a cavity 1713 longitudinally extending through the first free-rotation member 171. The second free-rotation member 172 has an outer surface 1721 and an inner surface 1722 which defines a cavity 1723 longitudinally extending through the second free-rotation member 172. The cavity 1713 of first free-rotation member 171 and the cavity 1723 of the second free-rotation member 172 are in fluid communication with each other and enable fluid communication between the tool string 50 and the hydra-jetting apparatus 100.

The first free-rotation member 171 and the second free-rotation member 172 freely rotate relative to each other along their longitudinal axis and allow free rotation of the hydra-jetting apparatus 100 along its longitudinal axis as it moves through the wellbore. A swivel member 1714 extending from the first rotation member 171 via a constricted neck 1715 is seated in a corresponding groove 1724 of the second free rotation member 172 via recess 1725. The swivel member 1714 has an outer diameter which is slightly smaller or substantially the same as an inner diameter of the groove 1724 to allow for the two elements to conformance fit each other. The constricted neck 1715 has an outer diameter which is slightly smaller or substantially the same as an inner diameter of the recess 1725 to allow for the two elements to conformance fit each other. The swivel member 1724 can be in the form of any one of a ball bearing, a roll bearing, a needle bearing, and slide bearing.

Rotatable couplings, such as described in FIG. 5, are common in the art, and available as, for example, a downhole swivel joint from manufacturers such as Logan Kline Tools or Wellvention. While the coupling surface 1716, coupling surface 1726, and coupling member 160 are shown as substantially cylindrical, one of ordinary skill in the art will understand that these components can be any shape, such as, for example, conical or tapered, which allows for threaded or otherwise engagement of the components. Also, while the tool string 50 and hydra-jetting apparatus 100 are coupled by the rotatable coupling 170 as described in FIG. 5, one of ordinary skill in the art will readily understand that any coupling that allows for free rotation of the hydra-jetting apparatus 100 relative to the tool string 50 as it moves along the wellbore can be used.

As shown in FIGS. 2-5, the rotatable coupling 170 is coupled to the tool string 50 via the first free-rotation member 171, the jet housing 110 is coupled to the second free-rotation member 172, and the guide housing 130 is coupled to the jet housing 110 opposite the rotatable coupling 170 such that the guide housing 130 is the furthest downhole. Alternatively, the rotatable coupling 170 can be coupled to the tool string 50 via the first free-rotation member 171, the guide housing 130 can be coupled to the second free-rotation member 172, and the jet housing 110 can be coupled to the guide housing 130 opposite the rotatable coupling 170 such that the jet housing 110 is the furthest downhole.

When the guide housing is the furthest downhole component, the downhole end of the guide housing of the hydra-jetting apparatus can be substantially flat such that it is perpendicular to the length of the hydra-jetting apparatus. Alternatively, the downhole side can be rounded, tapered, conical, or otherwise shaped such that is decreases in diameter from the substantially cylindrical outer surface to the terminus of the downhole end. The downhole end can be uniformly solid, or have a cavity running longitudinally therethrough which is in fluid communication with the cavity of the guide housing. The downhole end of the guide housing can be further configured to couple other components commonly used by one of ordinary skill in the art.

When the jet housing is the furthest downhole component, the downhole end of the jet housing of the hydra-jetting apparatus can be substantially flat such that it is perpendicular to the length of the hydra-jetting apparatus. Alternatively, the downhole end can be rounded, tapered, conical, or otherwise shaped such that is decreases in diameter from the substantially cylindrical outer surface to the terminus of the downhole end. The downhole end can be uniformly solid, or have a cavity running longitudinally therethrough which is in fluid communication with the cavity of the jet housing. The downhole end of the jet housing can be further configured to couple other components commonly used by one of ordinary skill in the art.

Figure 6:
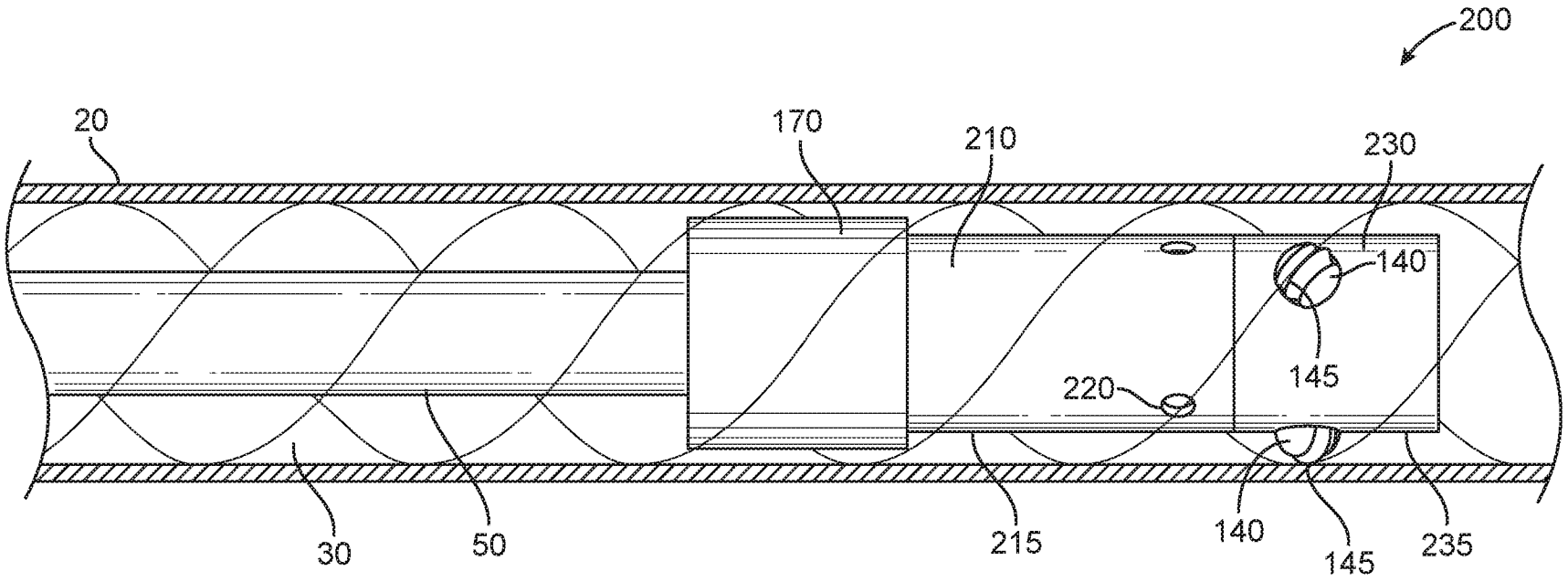
FIG. 6 is a diagram illustrating another exemplary hydra-jetting apparatus coupled to a tool string and situated in a wellbore.

FIG. 6 is a diagram illustrating another exemplary hydra-jetting apparatus 200 coupled to the tool string 50 and situated in the wellbore casing 20. Like the hydra-jetting apparatus 100, the hydra-jetting apparatus 200 has an outer surface and an inner surface which defines a cavity (not shown) longitudinally extending through the apparatus 200 which houses various components such as those described herein. The hydra-jetting apparatus 200 has a substantially cylindrical guide housing 230 and a substantially cylindrical jet housing 210 which are variably coupled to each other.

The guide housing 230 has an outer surface 235 and an inner surface (not shown) which can define a cavity (not shown) longitudinally extending through the guide housing 230. The cavity and outer surface of the hydra-jetting apparatus 200 includes the cavity and the outer surface 235 of the guide housing 230 respectively. The guide housing 230 further has a plurality of retractable guide members 140 attached radially around the guide housing 230. The guide members 140 are substantially the same as, and are located within and coupled to the guide housing 230 in same manner as, the guide members 140 of exemplary hydra-jetting apparatus 100 as described above.

The jet housing 210 has an outer surface 215 and an inner surface (not shown) which can define a cavity (not shown) longitudinally extending through the jet housing 210. The cavity of the hydra-jetting apparatus 200 includes the jet housing cavity. The jet housing 210 further has a plurality of jetting nozzles 220 defined in, and radially positioned about, the jet housing 210. The cavity of the jet housing 210 and the cavity of the guide housing 230 are in fluid communication with each other and form at least a portion of the cavity of the hydra-jetting apparatus 200. Each of the plurality of jetting nozzles 220 are adjustable relative to the guide housing 230 to allow substantial alignment of projections from the plurality of jetting nozzles 220 and the plurality of guide members 140 when the guide members 140 are extended radially from the outer surface 235 of the guide housing 230 and the apparatus 200 is actively moved through the wellbore casing 20. In the exemplary hydra-jetting apparatus 200, jetting nozzles 220 are apertures extending from the cavity and though the outer surface 215 of the jet housing 210. Alternatively, the jetting nozzles 220 can be conical, bell-shaped, annular, parallel, convergent, divergent, convergent-divergent, ring, flat tipped, current non-circular or any other nozzle shape known by one of ordinary skill in the art. Furthermore, the nozzle can be fully or partially contained within the jet housing 210. In general, the jetting nozzles 220 are configured to jet fluid in a direction which is perpendicular to the longitudinal axis of the hydra-jetting apparatus 100. One of ordinary skill in the art, however, will appreciate that jetting nozzles can be configured to jet fluid at any desired angle relative to the longitudinal axis of the hydra-jetting apparatus 200.

The outer surface 215 of the jet housing 210 and the outer surface 235 of the guide housing 230 can be substantially the same diameter, the inner surfaces of the jet housing 210 and guide housing 230 can be substantially the same diameter, and the cavities of the jet housing 210 and the guide housing 230 can be substantially the same diameter. Alternatively, the outer surface 215 of the jet housing 210 and the outer surface 235 of the guide housing 230 can be substantially the same diameter while the diameters of the inner surface and cavity of the guide housing 230 are larger than those of the jet housing 210. Alternatively, the outer surface 215 of the jet housing 120 and the outer surface 235 of the guide housing 230 can be substantially the same diameter while the diameters of the inner surface and cavity of the guide housing 230 are smaller than those of the jet housing 210.

As described above in relation to hydra-jetting apparatus 100 and as shown in FIGS. 2-4, when the jet housing 110 and guide housing 130 are together as one component, the number of jetting nozzles 220 can equal the number of guide members 140 multiplied by the number of angle settings. In exemplary hydra-jetting apparatus 200, the jet housing 210 and guide housing 230 are variably coupled to each other. When the jet housing 210 and guide housing 230 are variably coupled to each other, the number of jetting nozzles 220 and the number of guide members 140 can be the same. As shown in FIG. 6, the top guide member 140 and jetting nozzle 220 are on the same spiral, corkscrew, or helical path at a first guide member angle setting; each guide member 140 shares a spiral, corkscrew, or helical path or projection with a corresponding jetting nozzle 220. When the guide members 140 are actuated to exhibit a second guide member angle setting, the jet housing 210 can be rotated relative to the longitudinal axis of the hydra-jetting apparatus 200 until each guide member 140 and a corresponding jetting nozzle 220 again share a same spiral, corkscrew, or helical path. The number of guide members 140 can be from 2-8, alternatively 2-6, alternatively 3-5, or alternatively 4. The outer surface of the hydra-jetting apparatus 200 can be marked with one or more guide lines to assist in proper alignment of the spiral, corkscrew, or helical paths or projections at different guide member angle settings.

The guide housing 230 and jet housing 210 can be variably coupled by any form of coupling known by one of ordinary skill in the art. The cavity of the guide housing 230 can be threaded to render the cavity a female thread, and a male threaded insert, with a cavity extending longitudinally therethrough, can be connected to the inner surface of the jet housing 210 for threadedly coupling the respective housings. Alternatively, the cavity of the jet housing 210 can be threaded to render the cavity a female thread, and a male threaded insert, with a cavity extending longitudinally therethrough, can be connected to the inner surface of the guide housing 230 for threadedly coupling the respective housings.

When the guide housing and the jet housing are threadedly couplable, a spacer or O-ring of predefined thickness can be placed between the guide housing 230 and jet housing 210 to ensure proper alignment of the spiral, corkscrew, or helical path or projection of each guide member 140 and its corresponding jetting nozzle 220 when the guide member angle setting is changed.

The hydra-jetting apparatus 200 further includes a coupling mechanism (not shown, substantially similar to coupling mechanism 160), disposed within housing 170, which can be configured to threadedly or otherwise couple the hydra-jetting apparatus to the tool string 50 directly or indirectly through intervening components, such as swivel or bearing assemblies which allow for free rotation relative to the longitudinal axis of the apparatus as described above in regard to exemplary hydra-jetting apparatus 100. The coupling mechanism can have an outer surface (not shown) and an inner surface (not shown) which can define a cavity (not shown) longitudinally extending through the hydra-jetting apparatus 200. The cavity of the hydra-jetting apparatus 200 includes the coupling mechanism cavity. The cavity of the jet housing 210, the cavity of the guide housing 230, and the cavity of the coupling mechanism are in fluid communication with each other and form at least a portion of the cavity of the hydra-jetting apparatus 200.

Figure 7:
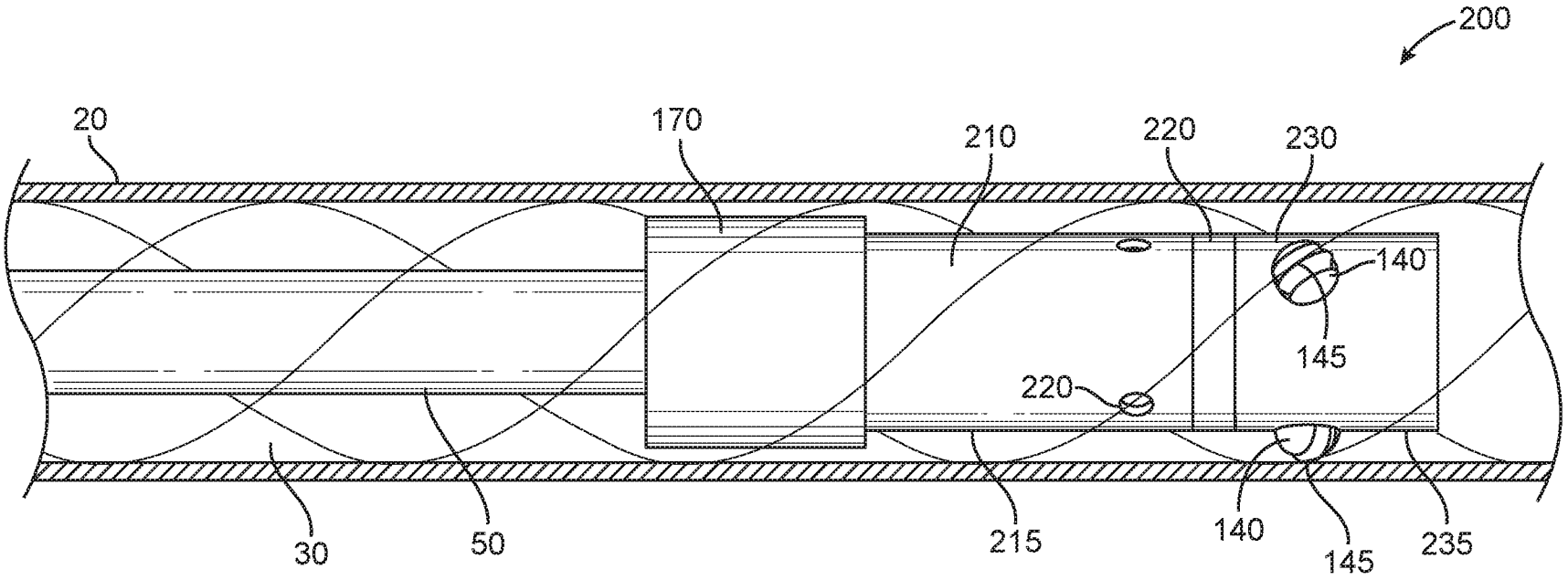
FIG. 7 is a diagram of a second configuration of the exemplary hydra-jetting apparatus of FIG. 6 coupled to the tool string and situated in the wellbore.

FIG. 7 is a diagram of a second configuration of the exemplary hydra-jetting apparatus 200 of FIG. 6 coupled to the tool string 50 and situated in the wellbore casing 20. Here, the centrally raised protrusion 145 is set to a second angle setting which results in a spiral, corkscrew, or helical path which does not initially coincide with jetting nozzle 220. To place the centrally raised protrusion 145 and jetting nozzle 220 on the same spiral, corkscrew, or helical path, a spacer 240, having a predefined thickness, is placed between the jet housing 210 and the guide housing 230 prior to threaded coupling. As shown, the relative position of the jetting nozzle does not change but is on the same spiral, corkscrew, or helical path as centrally raised protrusion 145 due to the presence of spacer 240. If the centrally raised protrusion 145 is set to a third angle setting, a spacer of a different predefined thickness can be provided to reach the same result. Spacers of various predefined thicknesses can be provided for various angle settings.

While the exemplary hydra-jetting apparatus 200 shown in FIGS. 6-7 is described wherein the centrally raised protrusions 145 are discussed as maintaining a same spiral, corkscrew, or helical path as jetting nozzles 220 through the use of spacers, one of ordinary skill may appreciate circumstances in which the guide members 140 and jetting nozzles 220 are situated relative to each other such that fluid jetting paths and the protrusion paths are not the same. In this case, the spacer 240 is not required and only the guide member angle setting will be changed. Furthermore, while the exemplary hydra-jetting apparatus 200 is shown as used in a wellbore with casing 20, one of ordinary skill may appreciate that the exemplary hydra-jetting apparatus 200 may be used in an uncased wellbore under certain conditions.

Figure 8:
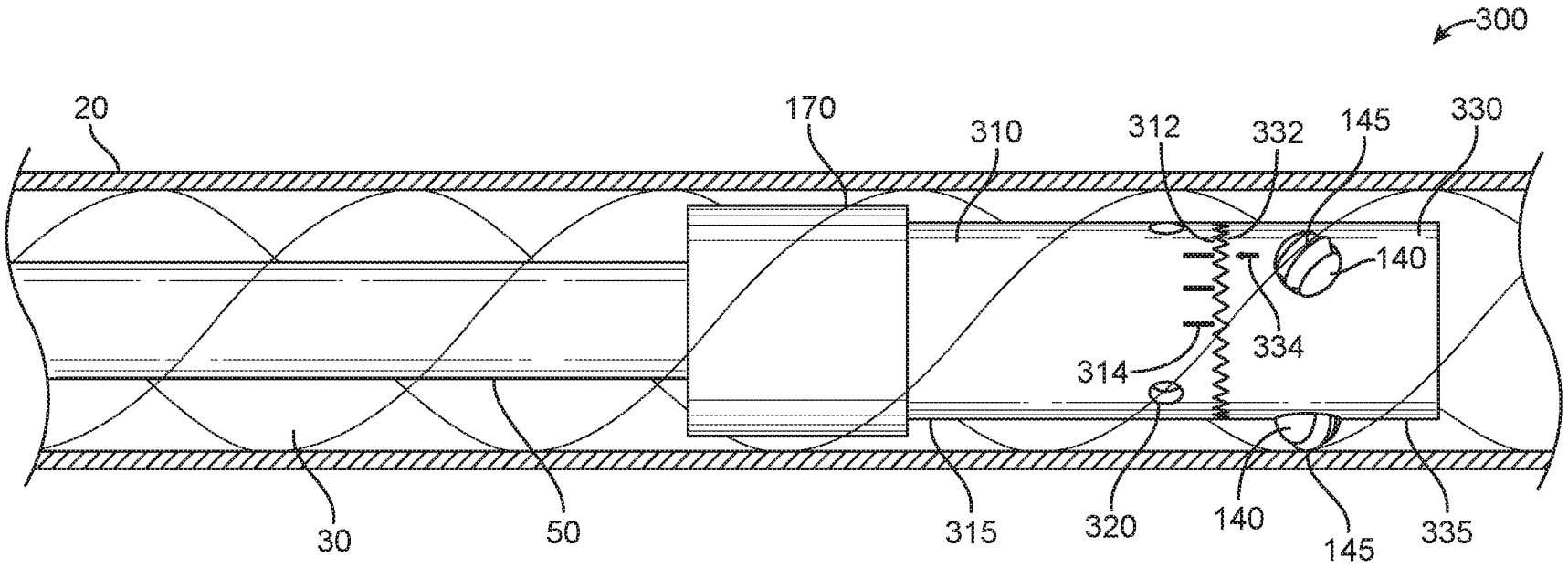
FIG. 8 is a diagram illustrating yet another exemplary hydra-jetting apparatus coupled to a tool string and situated in a wellbore.

FIG. 8 is a diagram illustrating yet another exemplary hydra-jetting apparatus 300 coupled to the tool string 50 and situated in the wellbore casing 20. Like the exemplary hydra-jetting apparatus 200, the hydra-jetting apparatus 300 has an outer surface and an inner surface which defines a cavity (not shown) longitudinally extending through the apparatus 300 which houses various components such as those described herein. The hydra-jetting apparatus 300 has a substantially cylindrical guide housing 330 and a substantially cylindrical jet housing 310.

The guide housing 330 has an outer surface 335 and an inner surface (not shown) which can define a cavity (not shown) longitudinally extending through the guide housing 330. The cavity and outer surface of the hydra-jetting apparatus 300 includes the cavity and the outer surface 335 of the guide housing 330 respectively. The guide housing 330 further includes a plurality of retractable guide members 140 attached radially around the guide housing 330. The guide members 140 are substantially the same as, and are located within and coupled to the guide housing 330 in same manner as, the guide members 140 of exemplary hydra-jetting apparatuses 100 and 200 as described above.

The jet housing 310 has an outer surface 315 and an inner surface (not shown) which can define a cavity (not shown) longitudinally extending through the jet housing 310. The cavity of the hydra-jetting apparatus 300 includes the jet housing cavity. The jet housing 310 further has a plurality of jetting nozzles 320 defined in, and radially positioned about, the jet housing 310. The cavity of the jet housing 310 and the cavity of the guide housing 330 are in fluid communication with each other and form at least a portion of the cavity of the hydra-jetting apparatus 300. Each of the plurality of jetting nozzles 320 are adjustable relative to the guide housing 330 to allow substantial alignment of projections from the plurality of jetting nozzles 320 and the plurality of guide members 140 when the guide members 140 are extended radially from the outer surface 335 of the guide housing 330 and the apparatus 300 is actively moved through the wellbore casing 20. In the exemplary hydra-jetting apparatus 300, jetting nozzles 320 are apertures extending from the cavity and though the outer surface 315 of the jet housing 310. Alternatively, the jetting nozzles 320 can be conical, bell-shaped, annular, parallel, convergent, divergent, convergent-divergent, ring, flat tipped, current non-circular or any other nozzle shape known by one of ordinary skill in the art. Furthermore, the nozzle can be fully or partially contained within the jet housing 310. In general, the jetting nozzles 320 are configured to jet fluid in a direction which is perpendicular to the longitudinal axis of the hydra-jetting apparatus 100. One of ordinary skill in the art, however, will appreciate that jetting nozzles can be configured to jet fluid at any desired angle relative to the longitudinal axis of the hydra-jetting apparatus 300.

The outer surface 315 of the jet housing 310 and the outer surface 335 of the guide housing 330 can be substantially the same diameter, the inner surfaces of the jet housing 310 and guide housing 330 can be substantially the same diameter, and the cavities of the jet housing 310 and the guide housing 330 can be substantially the same diameter. Alternatively, the outer surface 315 of the jet housing 310 and the outer surface 335 of the guide housing 330 can be substantially the same diameter while the diameters of the inner surface and cavity of the guide housing 330 are larger than those of the jet housing 310. Alternatively, the outer surface 315 of the jet housing 310 and the outer surface 335 of the guide housing 330 can be substantially the same diameter while the diameters of the inner surface and cavity of the guide housing 330 are smaller than those of the jet housing 310.

As with the exemplary hydra-jetting apparatus 200, the jet housing 310 and guide housing 330 of the hydra-jetting apparatus 300 are variably coupled to each other, and the number of jetting nozzles 320 and the number of guide members 140 are the same. The number of guide members 140 can be from 2-8, alternatively 2-6, alternatively 3-5, or alternatively 4. As shown in FIG. 8, the topmost guide member 140 and jetting nozzle 320 are on the same spiral, corkscrew, or helical path at a first guide member angle setting; each guide member 140 shares a spiral, corkscrew, or helical path with a corresponding jetting nozzle 320. The guide housing 330 and jet housing 310 can be marked with guide lines 334 and 314 respectively to ensure proper alignment of the guide members 140 with each corresponding jetting nozzle 320.

The guide housing 330 and jet housing 310 can be variably coupled by any form of coupling known by one of ordinary skill in the art. As illustrated by exemplary hydra-jetting apparatus 200, the cavities of the guide housing and the jet housing can be threadedly coupled. Alternatively, such as in exemplary hydra-jetting apparatus 300, the housings 310,330 can be connected by a quick connect snap lock-type mechanism (not shown). If a coupling mechanism such as a quick connect snap lock-type mechanism, or any functional equivalent, is used, the guide housing 330 and jet housing 310 can have grooved, corrugated, or otherwise shaped surfaces 332 and 312 respectively to increase the effective surface areas of the surfaces 312,332 of each housing 310,330 and increase the strength and stability of the hydra-jetting apparatus 300 when the housings 310,330 are coupled.

As shown in FIG. 8, guide housing guide line 334 is aligned with the top jet housing guide line 314 when the guide member 140 exhibits a first angle setting having a same spiral, corkscrew, or helical path as jetting nozzle 320. When the guide members 140 are actuated to exhibit a second guide member angle setting, the jet housing 310 can be decoupled from the guide housing 330, rotated relative to the longitudinal axis of the hydra-jetting apparatus 300 until each guide member 140 and a corresponding jetting nozzle 320 again share a same spiral, corkscrew, or helical path, and then recoupled to the guide housing 330.

The hydra-jetting apparatus 300 further includes a coupling mechanism (not shown, substantially similar to coupling mechanism 160), disposed within housing 170, which can be configured to threadedly or otherwise couple the hydra-jetting apparatus 300 to the tool string 50 directly or indirectly through intervening components, such as swivel or bearing assemblies which allow for free rotation relative to the longitudinal axis of the apparatus 300, as described above in regard to exemplary hydra-jetting apparatus 100. The coupling mechanism can have an outer surface (not shown) and an inner surface (not shown) which can define a cavity (not shown) longitudinally extending through the hydra-jetting apparatus 300. The cavity of the hydra-jetting apparatus 300 includes the coupling mechanism cavity. The cavity of the jet housing 310, the cavity of the guide housing 330, and the cavity of the coupling mechanism are in fluid communication with each other and form at least a portion of the cavity of the hydra-jetting apparatus 300.

Figure 9:
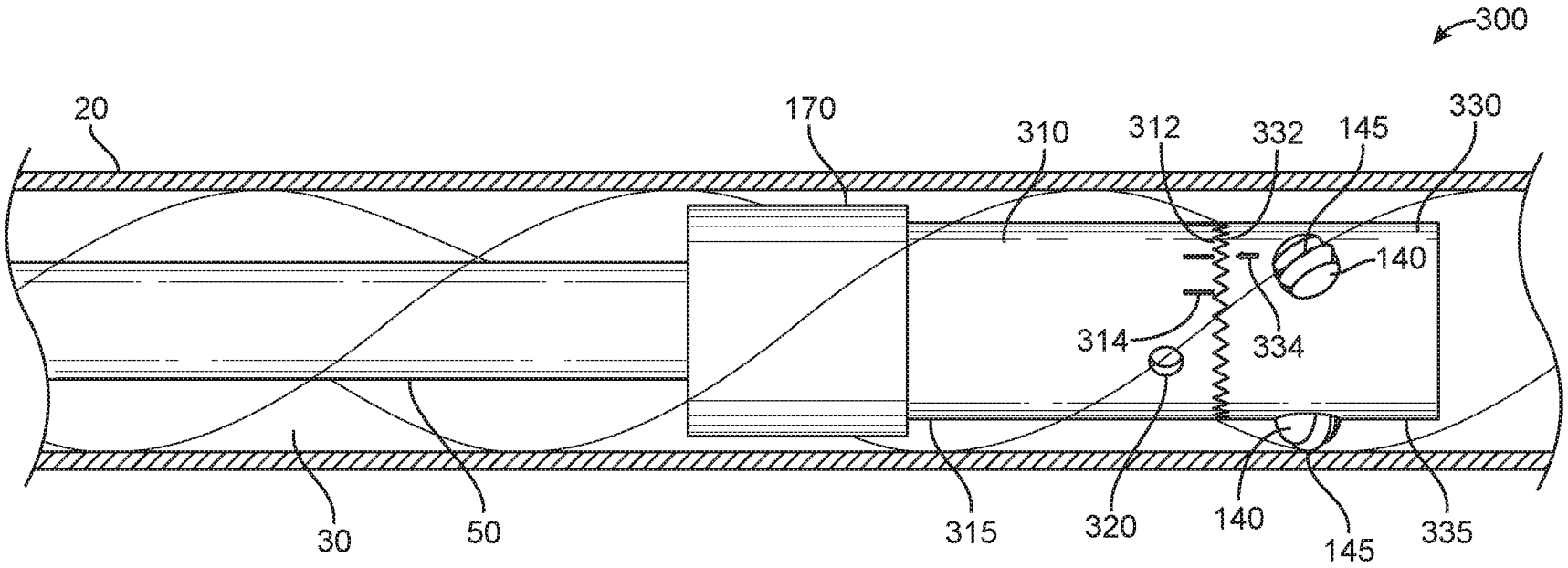
FIG. 9 is a diagram of a second configuration of the exemplary hydra-jetting apparatus of FIG. 8 coupled to the tool string and situated in the wellbore.

FIG. 9 is a diagram of a second configuration of the exemplary hydra-jetting apparatus 300 of FIG. 8 coupled to the tool string 50 and situated in the wellbore casing 20. Here, the centrally raised protrusion 145 is set to a second angle setting which results in a spiral, corkscrew, or helical path which does not initially coincide with jetting nozzle 320. To place the centrally raised protrusion 145 and jetting nozzle 320 on a same spiral, corkscrew, or helical path, the jet housing 310 is decoupled from the guide housing 330, rotated relative to the longitudinal axis of the hydra-jetting apparatus 300 until each guide member 140 and a corresponding jetting nozzle 320 again share the same spiral, corkscrew, or helical path, and then the jet housing 310 is recoupled to the guide housing 330. As shown, the guide housing guide line 334 is now aligned with the middle jet housing guide line 314, and the relative position of the jetting nozzle does changes to be on the same spiral, corkscrew, or helical path as centrally raised protrusion 145. The number of angle settings can be changed and each angle setting can have a corresponding jet housing guide line 314.

While the exemplary hydra-jetting apparatus 300 shown in FIGS. 8-9 is described wherein the centrally raised protrusions 145 are discussed as maintaining a same spiral, corkscrew, or helical path as jetting nozzles 320 by relative rotation of the jet housing 310 and guide housing 330, one of ordinary skill may appreciate circumstances in which the guide members 140 and jetting nozzles 320 are situated relative to each other such that fluid jetting paths and the protrusion paths are not the same. In this case, relative rotation of the jet housing and guide housing is not required and only the guide member angle setting will be changed. Furthermore, while the exemplary hydra-jetting apparatus 300 is shown as used in a wellbore with casing 20, one of ordinary skill may appreciate that the exemplary hydra-jetting apparatus 300 may be used in an uncased wellbore under certain conditions.

Figure 10:
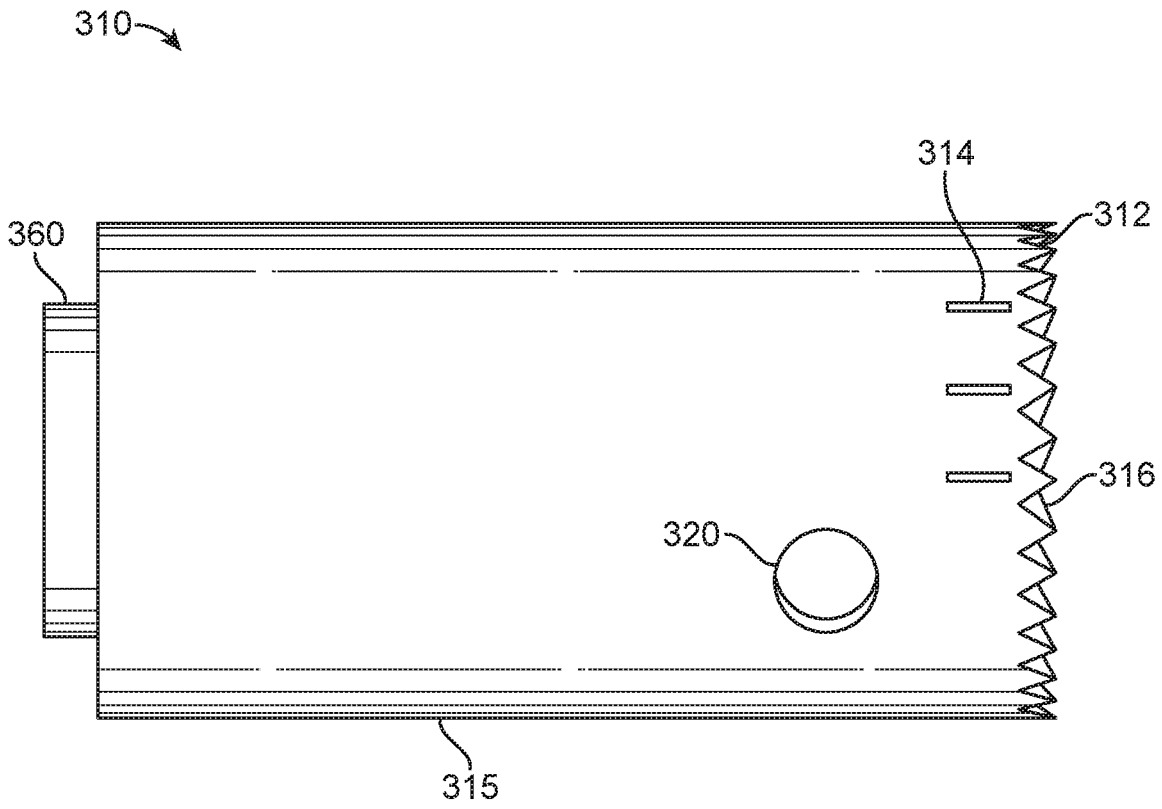
FIG. 10 is a diagram of the jet housing of the exemplary hydra-jetting apparatus of FIG. 8.

FIG. 10 is a diagram of the jet housing 310 of the exemplary hydra-jetting apparatus 300 of FIG. 8. As shown, the jet housing 310 has the outer surface 315, jetting nozzle 320, jet housing guide lines 314, and grooved, corrugated, or otherwise shaped surface 312. The jet housing 310 further includes coupling mechanism 360 configured to threadedly or otherwise couple the hydra-jetting apparatus 300 to the tool string 50 directly or indirectly through intervening components, such as swivel or bearing assemblies which allow for free rotation relative to the longitudinal axis of the apparatus as described above in regard to exemplary hydra-jetting apparatus 100. The coupling mechanism can have an outer surface (not shown) and an inner surface (not shown) which can define a cavity (not shown) longitudinally extending through the hydra-jetting apparatus 300. The jet housing 310 also includes a female or male portion 316 of a quick connect snap lock-type mechanism which will couple to male of female portion 336 of the guide housing 330 (See FIG. 11).

Figure 11:
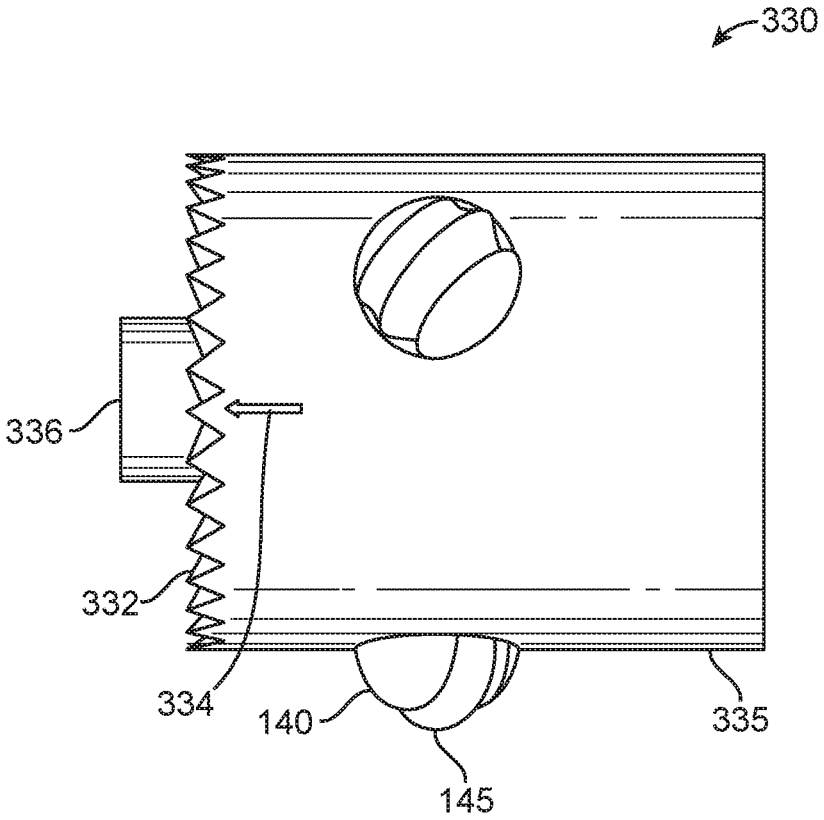
FIG. 11 is a diagram of the guide housing of the exemplary hydra-jetting apparatus of FIG. 8.
Figure 12A:
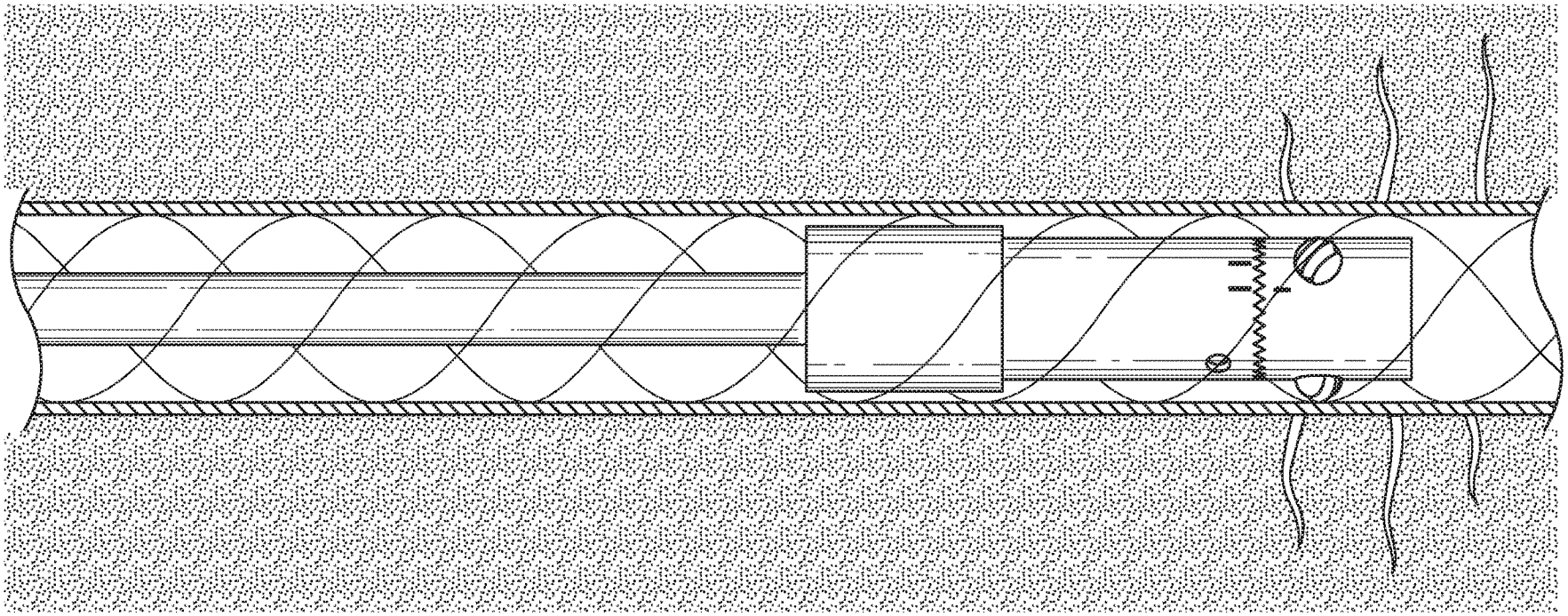
FIGS. 12-A-D are diagrams showing the exemplary hydra-jetting apparatus of FIG. 8 connected to the tool string and moving from right to left through the wellbore.
Figure 12B:
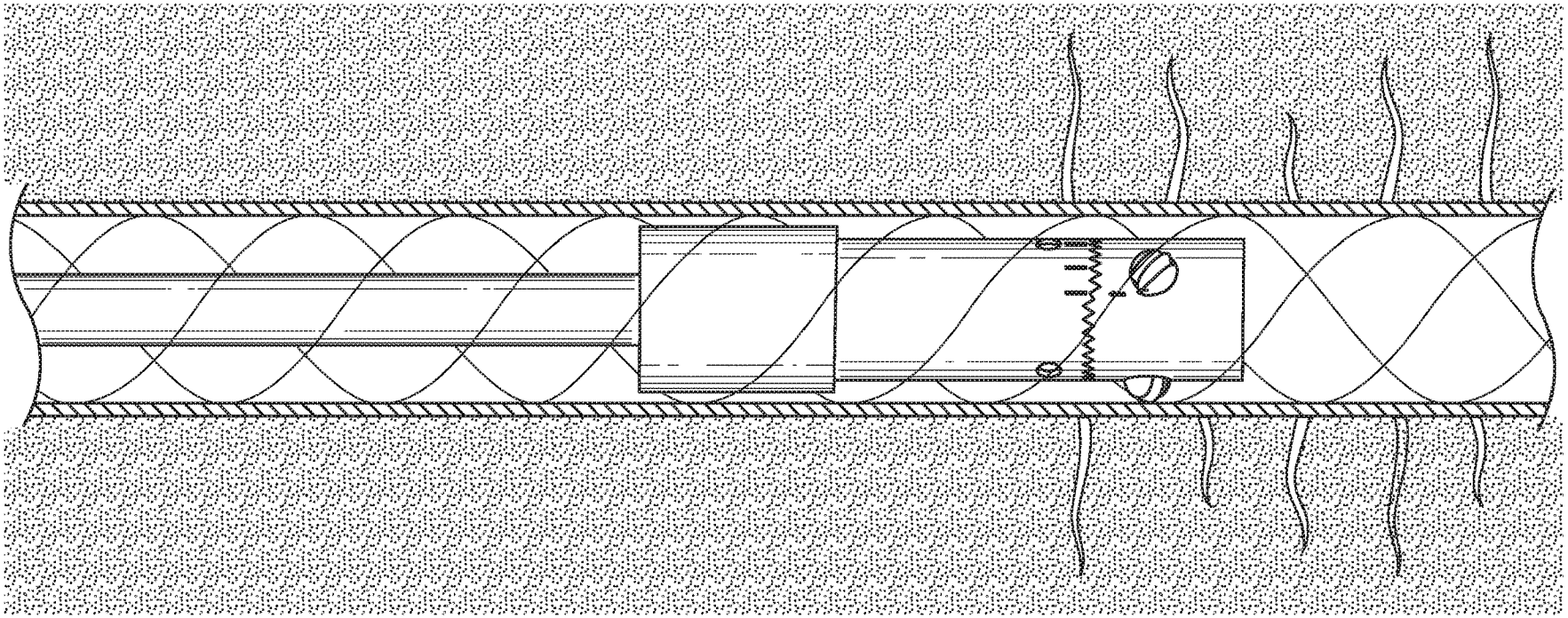
Figure 12C:
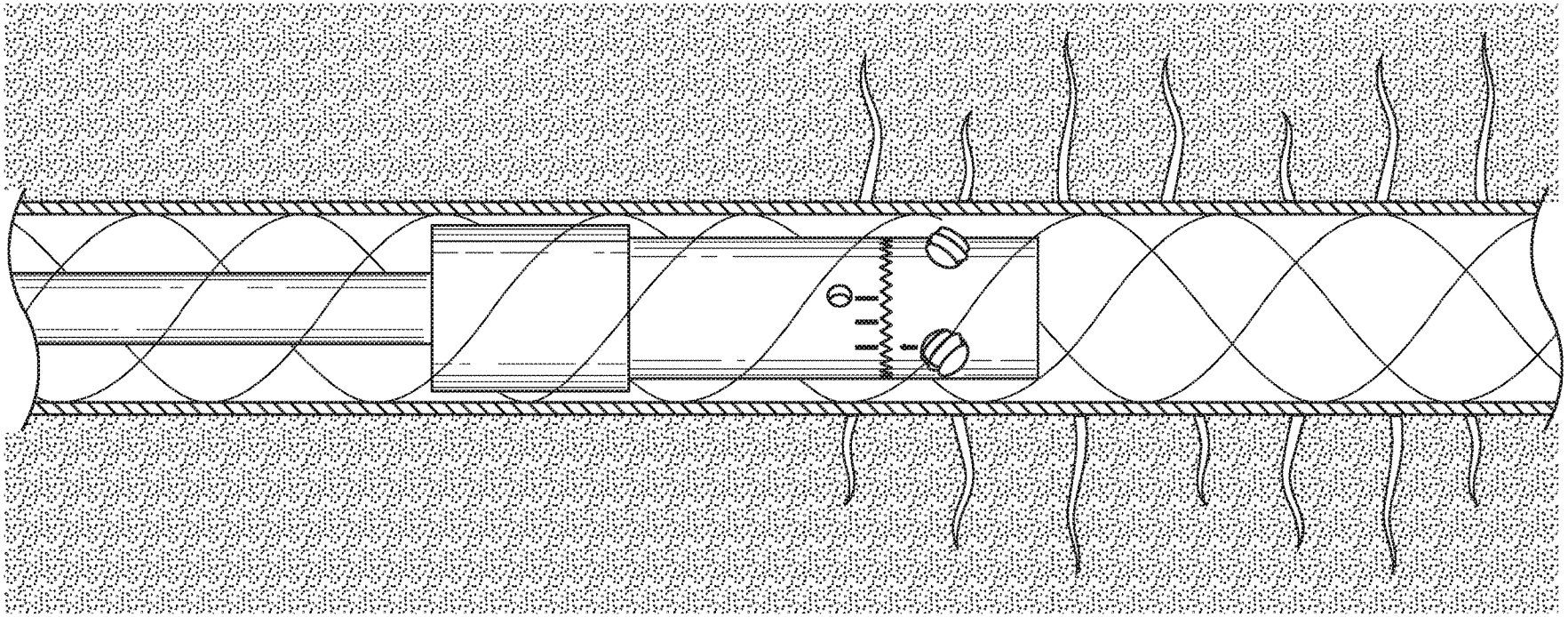
Figure 12D:
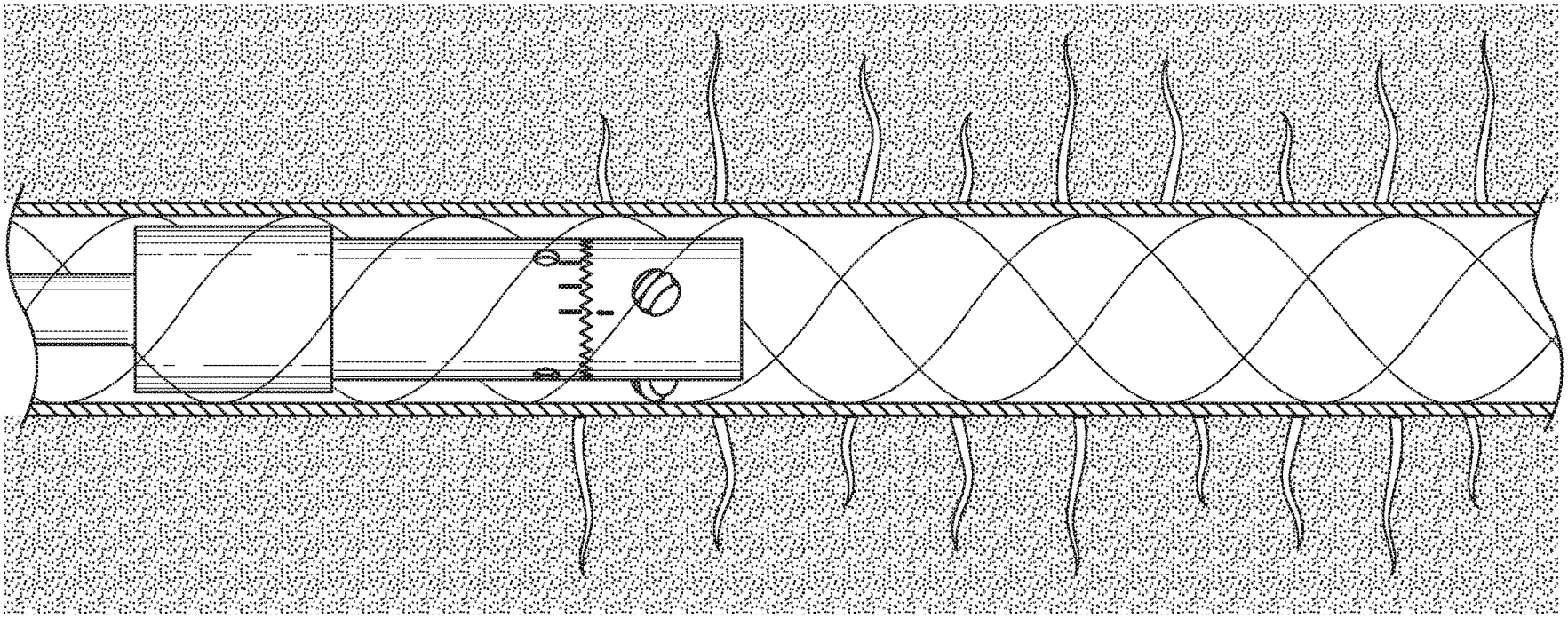

FIG. 11 is a diagram of the guide housing 330 of the exemplary hydra-jetting apparatus 300 of FIG. 8. As shown, the guide housing 330 has the outer surface 335, guide members 140 with centrally raised protrusions 145, guide housing guide line 334, and grooved, corrugated, or otherwise shaped surface 332. The guide housing 330 also includes a female or male portion 336 of a quick connect snap lock-type mechanism which will couple to male of female portion 316 of the jet housing 310 (See FIG. 10).

Also disclosed herein is a method of fracturing a formation penetrated by a cased or uncased wellbore. The method includes positioning a downhole hydra-jetting apparatus, as disclosed above, in a wellbore adjacent to a production zone. FIGS. 12A-D are diagrams showing the exemplary hydra-jetting apparatus 300 of FIG. 8 connected to the tool string 50 and moving from right to left through the wellbore 10 in accordance with an exemplary method described below. As shown in FIGS. 12A-D, the guide members and jet nozzles move along a helical path as the hydra-jetting apparatus moves from right to left in the well bore, with fractures forming in the subterranean formation due to the introduction of jetting fluid from the jetting nozzles.

As disclosed above, the downhole hydra-jetting apparatus can have a substantially cylindrical guide housing having an outer surface and an inner surface, and defining a cavity longitudinally extending through the guide housing; a plurality of retractable guide members attached radially around the guide housing; and a substantially cylindrical jet housing having an outer surface and an inner surface, and defining a cavity longitudinally extending through the jet housing, with a plurality of jetting nozzles defined in, and radially positioned about, the jet housing. Each of the plurality of jetting nozzles can be adjusted relative to the guide housing to allow substantial alignment of projections from the plurality of jetting nozzles and the plurality of guide members when the guide members are extended radially from the outer surface of the guide housing and the apparatus is actively moved through a downhole.

The method further includes extending the one or more of the plurality of retractable guide members radially from the outer surface of the guide housing to a deployed position to contact an inner surface of the wellbore or wellbore casing. After extending the one or more of the plurality of guide members to a deployed position to contact an inner surface of the wellbore, the downhole hydra-jetting apparatus is moved along the wellbore. During movement of the downhole hydra-jetting apparatus along the wellbore, either continuously or over predetermined increments of time, a pressurized perforation fluid is jetted through the jetting nozzles against the formation at a pressure sufficient to form perforation cavities of fractures in the formation that is in fluid communication with the wellbore. The method further includes jetting pressurized fracturing fluid through the jetting nozzles to further fracture the formation by stagnation pressure in the perforation cavities or fractures while maintaining the fluid communication. The jetting can form one or more continuous or segmented perforation cuts or slots along the inner surface of the wellbore. Each guide member can follow, or be seated in, a corresponding continuous or segmented perforation cut or slot to help ensure proper rotation of the hydra-jetting apparatus during movement relative to the inner surface of the wellbore.

The rate of pumping the fluid into the tool string and through the hydra-jetting apparatus is maintained at a level whereby the pressure of the jetted fluid reaches a jetting pressure sufficient to cause the creation of the perforation cavities or fractures in the subterranean formation. The differential pressure at which the fluids must be jetted from the jetting nozzles to further fracture the formation having perforation cavities or fractures can be approximately two or more times the pressure required to initiate the perforation cavities or fractures minus the ambient pressure in the wellbore adjacent the formation. The pressure required for initial perforation cavity or fracture formation is dependent upon the type of rock and/or other materials within the subterranean formation. Generally, after the wellbore is drilled into a formation, the fracture initiation pressure can be determined based upon the required drilling conditions or other considerations and mathematical relationships (such as, for example, pressure differential and fluid flow calculations) known to one of ordinary skill in the art.

The jetting fluids can include oil-based and aqueous drilling fluids. The drilling and aqueous fluids can include abrasives, fracture propping agents, or "proppants" (such as for example, sand, ceramic compositions, and/or bauxite compositions) mineral or organic acid solutions (such as, for example, hydrochloric acid, hydrofluoric, formic acid, and/or acetic acid), gelling agents, corrosion inhibitors, iron-control chemicals, chemicals for controlling sulfide cracking, foaming agents, other additives known to one of ordinary skill in the art, or any combination thereof.

As mentioned above, proppants can be combined with the fluid to be jetted. Proppants are carried in the fluid to the formed perforation cavities or fractures to maintain the structure of, or "prop open," the perforation cavities or fractures, which close after termination of fluid jetting. In order to insure that the proppants remain in the perforation cavities or fractures when they close, the jetting pressure can be gradually reduced to allow the perforation cavities or fractures to close on the proppants which are held in the perforation cavities or fractures by the fluid jetting during closure. In addition to propping the perforation cavities or fractures open, the presence of proppant in the fluid being jetted facilitates cutting and erosion of the formation. As disclosed, abrasive materials and acidic solutions can also be included in the jetting fluid to react with and dissolve, or other degrade, the formation to enlarge the perforation cavities or fractures as they are formed.

As disclosed above and understood by one of ordinary skill in the art, the perforation cavities or fractures can be extended into the formation by pumping a fluid into the wellbore to raise the ambient pressure therein. In carrying out the methods disclosed herein to form and extend perforation cavities or fractures, the hydra-jetting apparatus is positioned in the wellbore adjacent to a production zone in the subterranean formation and fluid is jetted through the jetting nozzles against the formation at a jetting pressure sufficient to form the perforation cavities or fractures. Once formation of the perforation cavities or fractures is accomplished, a fluid can be pumped into the wellbore at a rate sufficient to raise the ambient pressure in the wellbore adjacent the formation to a level such that the perforation cavities or fractures are extended and/or enlarged.

The fluid jetting process can be performed continuously to form a one or more substantially continuous helical perforation cuts or slots along the inner surface of the wellbore. In other embodiments, the fluid jetting process can be performed incrementally to form one or more segmented perforation cuts or slots along the inner surface wellbore in one or more helical paths. In all embodiments, the perforation cuts or slots should have a width larger than the width of the centrally raised protrusions of the generally spherical guide members or the width of the wheel shaped guide members, depending on the shape of guide members used.

When the jetting process is performed continuously, the fluid jetting resulting in initial perforation cavity or fracture formation and the fluid jetting resulting in extension and/or enlargement of the perforation cavities or fractures can be alternated gradually and continuously therebetween as the hydra-jetting apparatus moves along the wellbore. The gradual and continuous alternation can result in the formation of a continuous path of perforation cavities or fractures in a helical direction along the length of the wellbore with alternating regions of perforation cavities or fractures and regions of extended and/or enlarged perforation cavities or fractures.

When the fluid jetting process is performed incrementally, the hydra-jetting apparatus can be positioned in a region of the wellbore adjacent to a production zone and the fluid jetting resulting in initial perforation cavity or fracture formation and the fluid jetting resulting in extension and expansion of the perforation cavities or fractures are performed while the apparatus is kept substantially stationary in the production zone. After completion of the jetting process, the hydra-jetting apparatus can be moved along the wellbore, while maintaining its helical path, to a new production zone and the process is repeated.

Statements of the Disclosure Include:

Statement 1: A downhole hydra-jetting apparatus comprising a substantially cylindrical guide housing having an outer surface and an inner surface, and defining a cavity longitudinally extending through the guide housing, a plurality of retractable guide members attached radially around the guide housing, and a substantially cylindrical jet housing having an outer surface and an inner surface, and defining a cavity longitudinally extending through the jet housing, with a plurality of jetting nozzles defined in, and radially positioned about, the jet housing, wherein each of the plurality of jetting nozzles are positioned relative to the guide housing to allow substantial alignment of projections from the plurality of jetting nozzles and the plurality of guide members when the guide members are extended radially from the outer surface of the guide housing and the apparatus is actively moved through a downhole.

Statement 2: The downhole hydra-jetting apparatus according to Statement 1, wherein each of the plurality of retractable guide members are movable from a retracted position wherein the plurality of guide members do not extend beyond the outer surface of the guide housing, to a deployed position wherein at least a portion of one or more of the plurality of retractable guide members extend beyond the outer surface of the guide housing.

Statement 3: The downhole hydra-jetting apparatus according to Statement 1 or 2, wherein each of the plurality of guide members is retracted by a spring mechanism.

Statement 4: The downhole hydra-jetting apparatus according to any one of the preceding Statements 1-3, wherein each of the plurality of guide members is deployed in response to a change in pressure within the cavity of the guide housing.

Statement 5: The downhole hydra-jetting apparatus according to any one of the preceding Statements 1-4, further comprising any one of a swivel assembly or a bearing assembly on one end of the downhole hydra-jetting apparatus.

Statement 6: The downhole hydra-jetting apparatus according to any one of the preceding Statements 1-5, wherein each of the plurality of guide members is substantially cylindrical in shape with a spherical end and has a raised edge along a center line of the spherical end of the guide members.

Statement 7: The downhole hydra-jetting apparatus according to any one of the preceding Statements 1-6, wherein the angle of each of the guide members can be changed relative to the longitudinal axis of the guide housing.

Statement 8: The downhole hydra-jetting apparatus according to any one of the preceding Statements 1-7, wherein the jetting nozzles are adjustable relative to the guide members.

Statement 9: A system for fracturing a formation from within a cased or uncased wellbore, comprising a tool string, and a downhole hydra-jetting apparatus coupled with the tool string, according to any one of the preceding Statements 1-8.

Statement 10: A method of fracturing a formation penetrated by a wellbore comprising positioning a downhole hydra-jetting apparatus according to any one of the preceding Statements 1-8 in a wellbore adjacent to a formation to be fractured, extending the one or more of the plurality of retractable guide members radially from the outer surface of the guide housing to contact an inner surface of the wellbore, moving the downhole hydra-jetting apparatus along the wellbore, jetting a pressurized perforation fluid through the jetting nozzles against the formation at a pressure sufficient to form one or more perforation cavities or fractures in the formation that is in fluid communication with the wellbore, and jetting a pressurized fracturing fluid through the jetting nozzles to further fracture the formation by stagnation pressure in the one or more perforation cavities or fractures while maintaining the fluid communication.

Statement 11: The method according to Statement 10, wherein the fluid comprises one or more aqueous solutions, one or more acidic solutions, one or more abrasives, one or more proppants, or any combination thereof.

Statement 12: The method according to Statement 10 or 11, wherein the jetting is performed continuously to form a one or more substantially continuous helical perforation slots along the wellbore.

Statement 13: The method according to any one of the preceding Statements 10-12, wherein the jetting is performed incrementally to form one or more segmented perforation slots along the wellbore in one or more helical paths.

The foregoing descriptions of specific compositions and methods of the present disclosure have been presented for purposes of illustration and description. They are not intended to be exhaustive or to limit the disclosure to the precise compositions and methods disclosed and obviously many modifications and variations are possible in light of the above teaching. The examples were chosen and described in order to best explain the principles of the disclosure and its practical application, to thereby enable others skilled in the art to best utilize the disclosure with various modifications as are suited to the particular use contemplated. It is intended that the scope of the disclosure be defined by the claims appended hereto and their equivalents.

The invention claimed is:

1. A downhole hydra-jetting apparatus comprising:

a substantially cylindrical guide housing having an outer surface and an inner surface, and defining a cavity longitudinally extending through the guide housing;

a plurality of retractable guide members attached radially around the guide housing; and a substantially cylindrical jet housing having an outer surface and an inner surface, and defining a cavity longitudinally extending through the jet housing, with a plurality of jetting nozzles defined in, and radially positioned about, the jet housing;

wherein each of the plurality of jetting nozzles are positioned and aligned relative to the guide housing to allow ejected fluid from the plurality of jetting nozzles to create a continuous helical path on an inner surface of a casing or borehole, the helical path aligned with the plurality of guide members when the guide members are extended radially from the outer surface of the guide housing and the apparatus is rotated and axially translated within the casing or borehole, wherein each of the plurality of guide members is substantially cylindrical in shape with a spherical end and has a raised edge along a center line of the spherical end of the guide members.

2. The downhole hydra-jetting apparatus of claim 1, wherein each of the plurality of retractable guide members are movable from a retracted position wherein the plurality of guide members do not extend beyond the outer surface of the guide housing, to a deployed position wherein at least a portion of one or more of the plurality of retractable guide members extend beyond the outer surface of the guide housing.

3. The downhole hydra-jetting apparatus of claim 2, wherein each of the plurality of guide members is retracted by a spring mechanism.

4. The downhole hydra-jetting apparatus of claim 2, wherein each of the plurality of guide members is deployed in response to a change in pressure within the cavity of the guide housing.

5. The downhole hydra-jetting apparatus of claim 1, further comprising any one of a swivel assembly or a bearing assembly on one end of the downhole hydra-jetting apparatus.

6. The downhole hydra-jetting apparatus of claim 1, wherein an angle of each of the guide members can be changed relative to a longitudinal axis of the guide housing.

7. The downhole hydra-jetting apparatus of claim 1, wherein the jetting nozzles are adjustable relative to the guide members.

8. A system for fracturing a formation from within a cased or uncased wellbore, comprising:

a tool string; and a downhole hydra-jetting apparatus coupled with the tool string, the downhole hydra-jetting apparatus comprising:

a substantially cylindrical guide housing having an outer surface and an inner surface, and defining a cavity longitudinally extending through the guide housing;

a plurality of retractable guide members attached radially around the guide housing;

a substantially cylindrical jet housing having an outer surface and an inner surface, and defining a cavity longitudinally extending through the jet housing, with a plurality of jetting nozzles defined in, and radially positioned about, the jet housing;

wherein, each of the plurality of jetting nozzles are positioned and aligned relative to the guide housing to allow ejected fluid from the plurality of jetting nozzles to create a continuous helical path on an inner surface of a casing or borehole, the helical path aligned with the plurality of guide members when the guide members are extended radially from the outer surface of the guide housing and the apparatus is rotated and axially translated within the casing or borehole, wherein each of the plurality of guide members is substantially cylindrical in shape with a spherical end and has a raised edge along a center line of the spherical end of the guide members.

9. The system of claim 8, wherein each of the plurality of retractable guide members is movable from a retracted position wherein the plurality of guide members do not extend beyond the outer surface of the guide housing and the downhole hydra-jetting apparatus is smaller in diameter than the inner diameter of the wellbore, to a deployed position wherein at least a portion of one or more of the plurality of retractable guide members extend beyond the outer surface of the guide housing to engage an inner surface of a wellbore and the diameter of the hydra-jetting apparatus is slightly larger than the inner diameter of the well bore.

10. The system of claim 9, wherein each of the plurality of guide members is retracted by a spring mechanism.

11. The system of claim 9, wherein each of the plurality of guide members is deployed in response to a change in pressure within the cavity of the guide housing.

12. The system of claim 8, further comprising any one of a swivel assembly or a bearing assembly on one end of the downhole hydra-jetting apparatus.

13. The system of claim 8, wherein the angle of each of the guide members can be changed relative to the longitudinal axis of the guide housing.

14. The system of claim 8, wherein the jetting nozzles are adjustable relative to the guide members.

15. A method of fracturing a formation penetrated by a wellbore comprising:

positioning a downhole hydra-jetting apparatus in a wellbore adjacent to a formation to be fractured, the downhole hydra-jetting apparatus comprising:

a substantially cylindrical guide housing having an outer surface and an inner surface, and defining a cavity longitudinally extending through the guide housing;

a plurality of retractable guide members attached radially around the guide housing; and a substantially cylindrical jet housing having an outer surface and an inner surface, and defining a cavity longitudinally extending through the jet housing, with a plurality of jetting nozzles defined in, and radially positioned about, the jet housing;

wherein, each of the plurality of jetting nozzles are positioned relative to the guide housing to allow substantial alignment of the plurality of jetting nozzles and the plurality of guide members when the guide members are extended radially from the outer surface of the guide housing and the apparatus is rotated and axially translated within the casing and borehole;

extending the one or more of the plurality of retractable guide members radially from the outer surface of the guide housing to contact an inner surface of the wellbore;

moving the downhole hydra-jetting apparatus along the wellbore;

jetting a pressurized perforation fluid through the jetting nozzles against the formation at a pressure sufficient to form one or more perforation cavities or fractures in the formation that is in fluid communication with the wellbore; and jetting a pressurized fracturing fluid through the jetting nozzles to further fracture the formation by stagnation pressure in the one or more perforation cavities or fractures while maintaining the fluid communication, wherein the jetting is performed continuously to form one or more substantially continuous helical perforation slots along the wellbore.

16. The method of claim 15, wherein the fluid comprises one or more aqueous solutions, one or more acidic solutions, one or more abrasives, one or more proppants, or any combination thereof.

17. The method of claim 15, wherein the jetting is performed incrementally to form one or more segmented perforation slots along the wellbore in one or more helical paths.

18. A downhole hydra-jetting apparatus comprising:

a substantially cylindrical guide housing having an outer surface and an inner surface, and defining a cavity longitudinally extending through the guide housing;

a plurality of retractable guide members attached radially around the guide housing; and a substantially cylindrical jet housing having an outer surface and an inner surface, and defining a cavity longitudinally extending through the jet housing, with a plurality of jetting nozzles defined in, and radially positioned about, the jet housing;

wherein each of the plurality of jetting nozzles are positioned relative to the guide housing to allow substantial alignment of the plurality of jetting nozzles and the plurality of guide members when the guide members are extended radially from the outer surface of the guide housing and the apparatus is rotated and axially translated within the casing or borehole, and wherein each of the plurality of guide members is substantially cylindrical in shape with a spherical end and has a raised edge along a center line of the spherical end of the guide members.

19. A system for fracturing a formation from within a cased or uncased wellbore, comprising:

a tool string; and a downhole hydra-jetting apparatus coupled with the tool string, the downhole hydra-jetting apparatus comprising:

a substantially cylindrical guide housing having an outer surface and an inner surface, and defining a cavity longitudinally extending through the guide housing;

a plurality of retractable guide members attached radially around the guide housing;

a substantially cylindrical jet housing having an outer surface and an inner surface, and defining a cavity longitudinally extending through the jet housing, with a plurality of jetting nozzles defined in, and radially positioned about, the jet housing;

wherein, each of the plurality of jetting nozzles are positioned relative to the guide housing to allow substantial alignment of the plurality of jetting nozzles and the plurality of guide members when the guide members are extended radially from the outer surface of the guide housing and the apparatus is rotated and axially translated within the casing or borehole, and wherein each of the plurality of guide members is substantially cylindrical in shape with a spherical end and has a raised edge along a center line of the spherical end guide members.

* * * * *